US006653579B2

(12) United States Patent
Inoue et al.

(10) Patent No.: US 6,653,579 B2
(45) Date of Patent: Nov. 25, 2003

(54) MULTI-DIRECTIONAL INPUT JOYSTICK SWITCH

(75) Inventors: Hiroto Inoue, Kyoto (JP); Tamotsu Yamamoto, Hyogo (JP); Masaki Sawada, Osaka (JP); Hiroaki Nishiono, Osaka (JP)

(73) Assignee: Matsushita Electrical Industrial Co., Ltd., Osaka (JP)

( * ) Notice: Subject to any disclaimer, the term of this patent is extended or adjusted under 35 U.S.C. 154(b) by 0 days.

(21) Appl. No.: 10/148,800

(22) PCT Filed: Oct. 5, 2001

(86) PCT No.: PCT/JP01/08791

§ 371 (c)(1),
(2), (4) Date: Sep. 20, 2002

(87) PCT Pub. No.: WO02/29837

PCT Pub. Date: Apr. 11, 2002

(65) Prior Publication Data

US 2003/0057062 A1 Mar. 27, 2003

(30) Foreign Application Priority Data

Oct. 5, 2000 (JP) ..... 2000-305824

(51) Int. Cl.[7] ..... H01H 25/04
(52) U.S. Cl. ..... 200/6 A
(58) Field of Search ..... 200/5 R, 5 A, 200/6 A, 511, 512; 345/161; 338/99, 118, 185

(56) References Cited

U.S. PATENT DOCUMENTS

| | | | | | |
|---|---|---|---|---|---|
| 4,246,452 | A | | 1/1981 | Chandler | |
| 4,408,103 | A | * | 10/1983 | Smith | 200/6 A |
| 4,511,769 | A | * | 4/1985 | Sahakian et al. | 200/6 A |
| 4,595,855 | A | | 6/1986 | Farrall | |
| 4,687,200 | A | * | 8/1987 | Shirai | 200/6 A X |
| 4,896,003 | A | * | 1/1990 | Hsieh | 200/6 A |
| 5,313,027 | A | * | 5/1994 | Inoue et al. | 200/5 A |
| 5,473,126 | A | * | 12/1995 | Wu | 200/6 A |
| 5,488,206 | A | * | 1/1996 | Wu | 200/511 X |
| 5,525,770 | A | * | 6/1996 | Matsumiya et al. | 200/6 A |
| 5,949,325 | A | * | 9/1999 | Devolpi | 338/154 |
| 6,399,904 | B1 | * | 6/2002 | Mimata | 200/6 A |

FOREIGN PATENT DOCUMENTS

| | | |
|---|---|---|
| JP | 6-68741 | 3/1994 |
| JP | 7-84717 | 3/1995 |
| JP | 9-120377 | 5/1997 |
| JP | 10-125180 | 5/1998 |
| JP | 10-149737 | 6/1998 |
| JP | 11-126126 | 5/1999 |
| JP | 11-232027 | 8/1999 |
| JP | 3069727 | 4/2000 |

* cited by examiner

*Primary Examiner*—J. R. Scott
(74) *Attorney, Agent, or Firm*—Wenderoth, Lind & Ponack, L.L.P.

(57) ABSTRACT

When elastic driver (13) tilts, elastic pressing portion (13B) thereof depresses the upper face of flexible insulated substrate (15), thereby bringing circular-ring-like upper resistor layer (16) on the bottom face of flexible insulated substrate (15) into partial contact with lower conductor layer (17) opposed to the upper resistor layer. In this state, a computing unit (not shown) recognizes the tilt direction and the tilt angle of elastic driver (13) according to information from leads of upper resistor layer (16) and lower conductor layer (17).

24 Claims, 29 Drawing Sheets

FIG. 27 - PRIOR ART
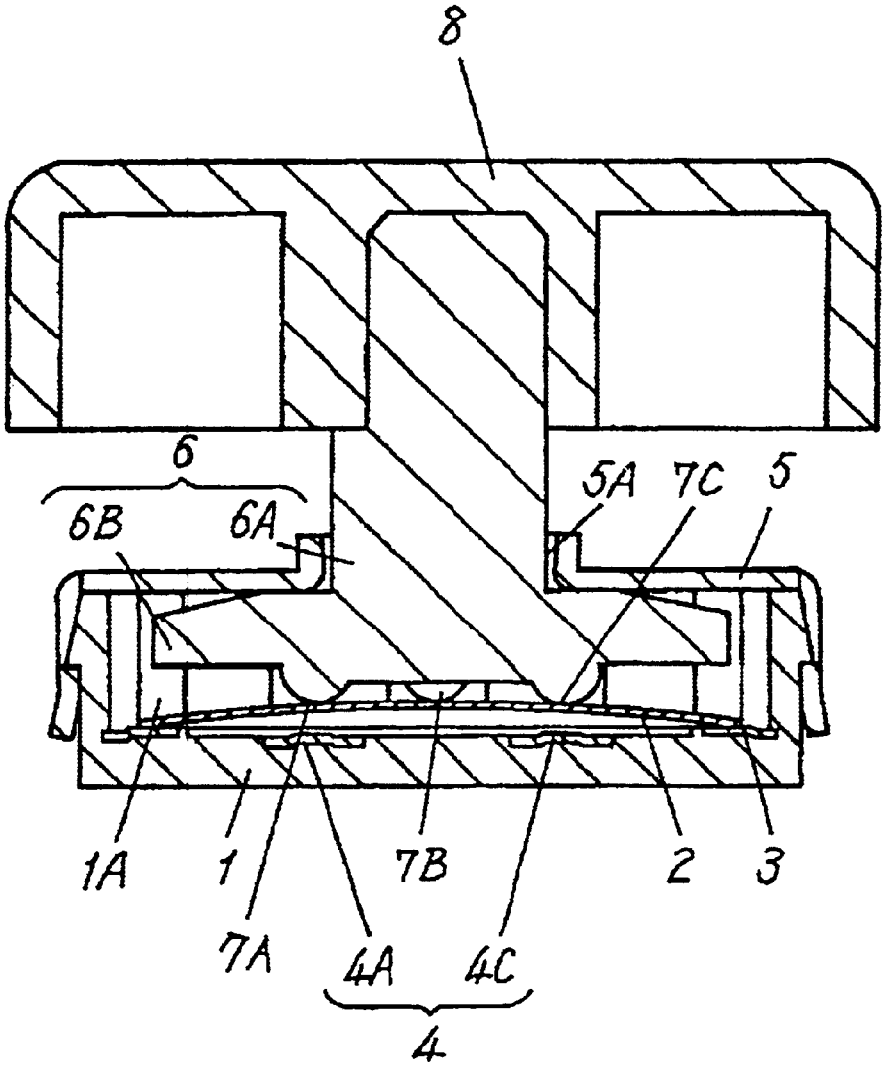

FIG. 28 - PRIOR ART
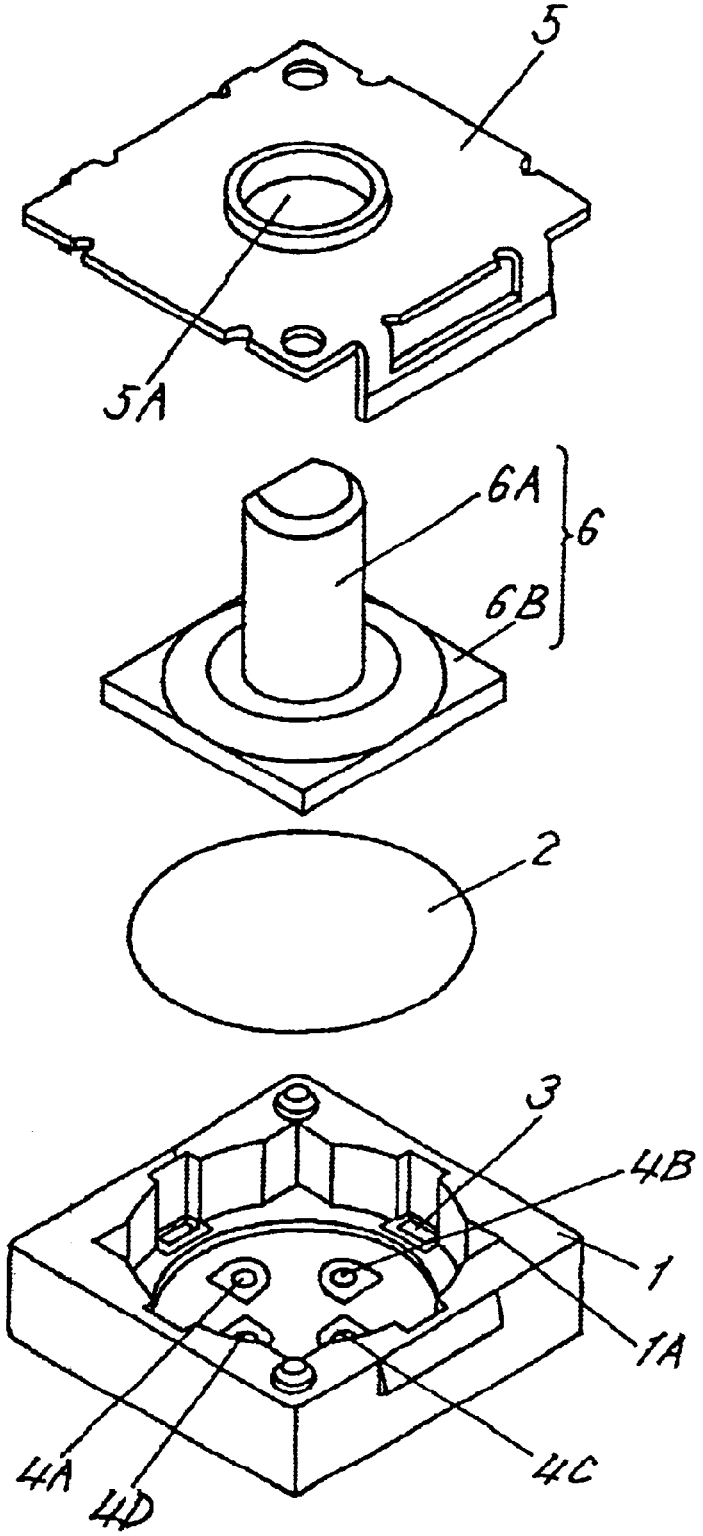

FIG. 29 - PRIOR ART
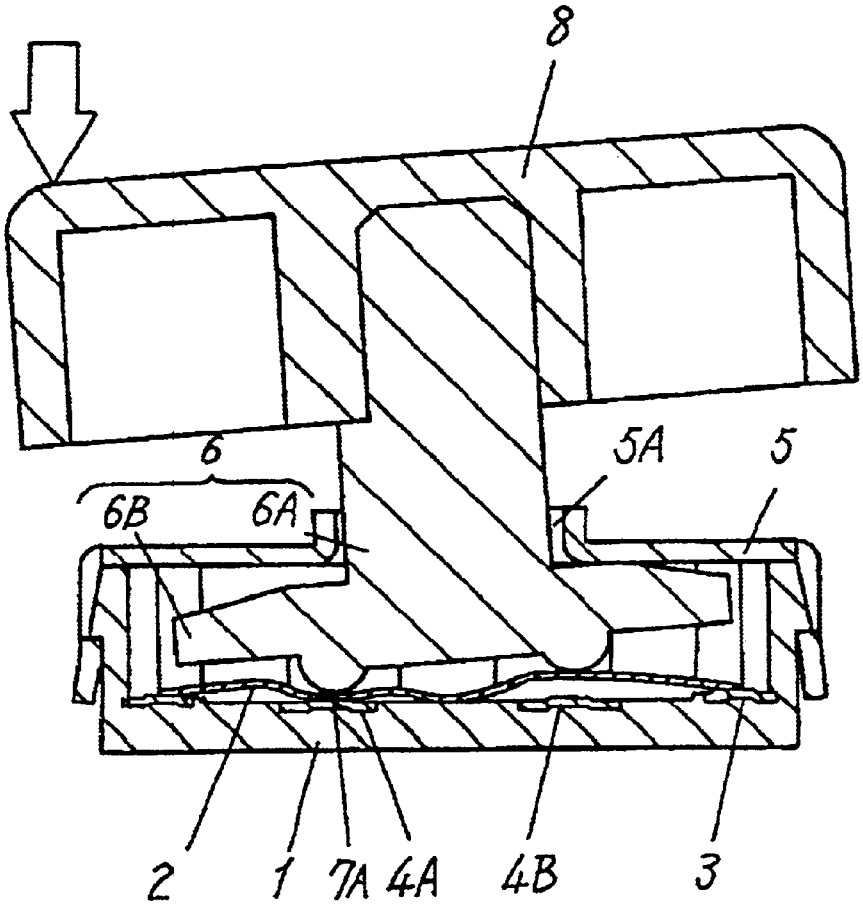

MULTI-DIRECTIONAL INPUT JOYSTICK SWITCH

FIELD OF THE INVENTION

The present invention relates to a multi-directional input device used for input operation in various kinds of electronic equipment, such as a cell phone, information terminal, video game machine, and remote control. The present invention also relates to electronic equipment using the multi-directional input device.

BACKGROUND OF THE INVENTION

A multi-way input device using a multi-way operating switch, which is disclosed in Japanese Patent Non-Examined Publication No. H10-125180, is known as a conventional multi-directional input device of this kind. The structure and operation of the multi-way operating switch are described with reference to FIGS. 27 to 29.

FIG. 27 is a sectional view of the multi-way operating switch. FIG. 28 is an exploded perspective view thereof. With reference to the drawings, box-like case 1 of an insulating resin houses dome-like movable contact 2 of a resilient metallic thin plate in the center of the case. At the ends of the inside bottom surface of box-like case 1, four outside fixed contacts 3 in electrical continuity with one another are disposed. Inside of outside fixed contacts 3, a plurality of (four, in this case) separate inner side fixed contacts 4 (4A to 4D) are arranged in positions equidistant from the center of dome-like movable contact 2 so as to be spaced equally. Mounted over the outside fixed contacts 3 is the outer peripheral edge of dome-like movable contact 2. Output terminals (not shown) in electrical continuity with each of fixed contacts are led to the outside. The opening through the top face of box-like case 1 is covered with cover 5. Operating body 6 comprises shaft 6A, and flange 6B integrally formed with the bottom end of the shaft. Shaft 6A projects from through hole 5A in the center of cover 5. Knob 8 is attached to the tip of the shaft. Flange 6B is fitted in inner wall 1A of case 1 and housed therein so that flange 6B cannot rotate but can tilt. Four pressing body 7 (7A to 7D, 7D not shown) on the bottom face of flange 6B corresponding to the four inner side fixed contacts 4 are in contact with the top face of dome-like movable contact 2. This contact urges the top face of flange 6B against the backside of cover 5 and keeps operating body 6 in vertical neutral position.

With a multi-way switch structured as above, when the left top face of knob 8 is depressed downwardly as shown by the arrow in a sectional view of FIG. 29, operating body 6 tilts from the vertical neutral position shown in FIG. 27 to the left side around a fulcrum at the right top face of flange 6B. Pressing body 7A depresses dome-like movable contact 2 and resiliently and partially turns it inside out and brings dome-like movable contact 2 into contact with inner side fixed contact 4A corresponding to pressing body 7A. This action short-circuits outside fixed contact 3 and inner side fixed contact 4A and brings them into the ON state. Then, an electric signal thereof is transmitted to the outside via the output terminals. When the depressing force applied to knob 8 is removed, operating body 6 is returned to its original vertical neutral position by the restoring force of dome-like movable contact 2. Thus, outside fixed contact 3 and inner side fixed contact 4A are returned to the OFF state.

In multi-way input device using this multi-way operating switch, a computing unit, such as a micro computer, recognizes a direction in which operating body 6 is tilted, according to the above-mentioned electric signal. The signal informs which one of four inner side fixed contacts 4 outside fixed contact 3 is in electrical continuity with. Then, the computing unit generates a signal indicating the direction in which operating body 6 is tilted, i.e. an input direction.

In the above-mentioned conventional multi-way operating switch, the number of directions in which input operation can be performed, i.e. resolution of input directions, is determined by the number of inner side fixed contacts 4 with which dome-like movable contact 2 partially and resiliently turning inside out can make contact. In order to ensure stable performance of the multi-way operating switch of a size for use in recent downsized electronic equipment, setting the number of inner side fixed contacts 4 more than four is difficult. Therefore, a number of input directions of eight is considered as the limit because the input direction is recognized intermediate between adjacent two inner side fixed contacts when they are both in the ON state.

DISCLOSURE OF THE INVENTION

The present invention addresses the conventional problem discussed above. Therefore, the present invention aims to provide a multi-directional input device that has a size for use in recent downsized electronic equipment and a large number of input directions, i.e. high resolution of input directions, and to provide electronic equipment using the input device.

The multi-directional input device of the present invention has an electronic component for input.

The electronic component for input comprises:

- an upper resistor layer on the bottom face of a flexible insulated substrate, formed like a circular ring having a predetermined width, and having two leads, one lead in electrical continuity with all inner circumference and the other lead in electrical continuity with all outer circumference of the circular ring;
- a lower conductor layer on a planar board, disposed like a circular ring so as to be opposed to the upper resistor layer with a predetermined insulation gap, and having a predetermined lead; and
- an elastic driver mounted on the flexible insulated substrate, the elastic driver having, on the bottom face thereof, a disk-like elastic pressing portion that is opposed to the backside of the upper resistor layer with a predetermined clearance, the driver having, on the top face thereof, a spherical portion rotatably engaged in a circular hole through a top cover and a driving knob portion in the center of the spherical portion. When the elastic driver tilts, the elastic pressing portion partially and downwardly warps the flexible insulated substrate, thereby bringing the upper resistor layer and the lower conductor layer in the tilt direction into partial contact with each other.

In this state, a tilt direction and a tilt angle of the elastic driver are recognized according to the information from the leads of the upper resistor layer and the lower conductor layer at high resolution. The multi-directional input device of the present invention can improve the resolution of the tilt directions in which the elastic driver is tilted, i.e. input directions. In addition, it can further divide input directions according to the angles at which the elastic driver is tilted. Therefore, the multi-directional input device of the present invention has an extremely high resolution.

BRIEF DESCRIPTION OF THE DRAWINGS

FIG. 27 is a sectional view of a conventional multi-way operating switch for use in multi-way input device.

FIG. 28 is an exploded perspective view of the multi-way operating switch.

FIG. 29 is a sectional view of the multi-way operating switch when an operating body thereof is tilted.

PREFERRED EMBODIMENTS OF THE INVENTION

Preferred embodiments of the present invention are demonstrated hereinafter with reference to the accompanying drawings.

(First Exemplary Embodiment)

Figure 1:
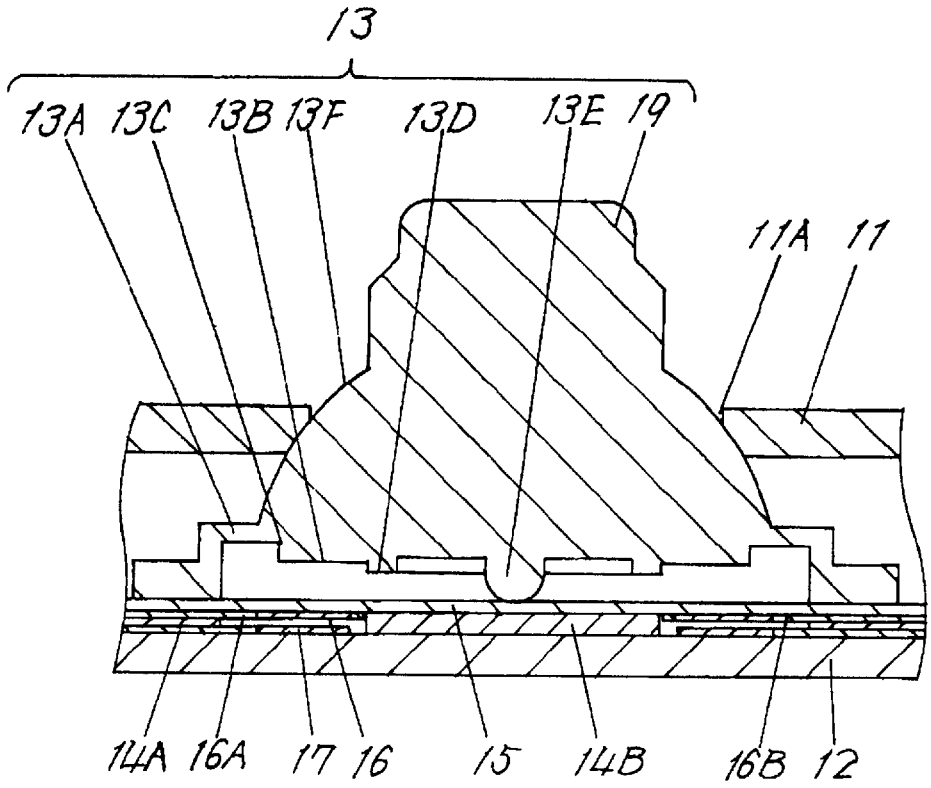
FIG. 1 is a sectional view of an essential part of a multi-directional input device in accordance with a first exemplary embodiment of the present invention.
Figure 2:
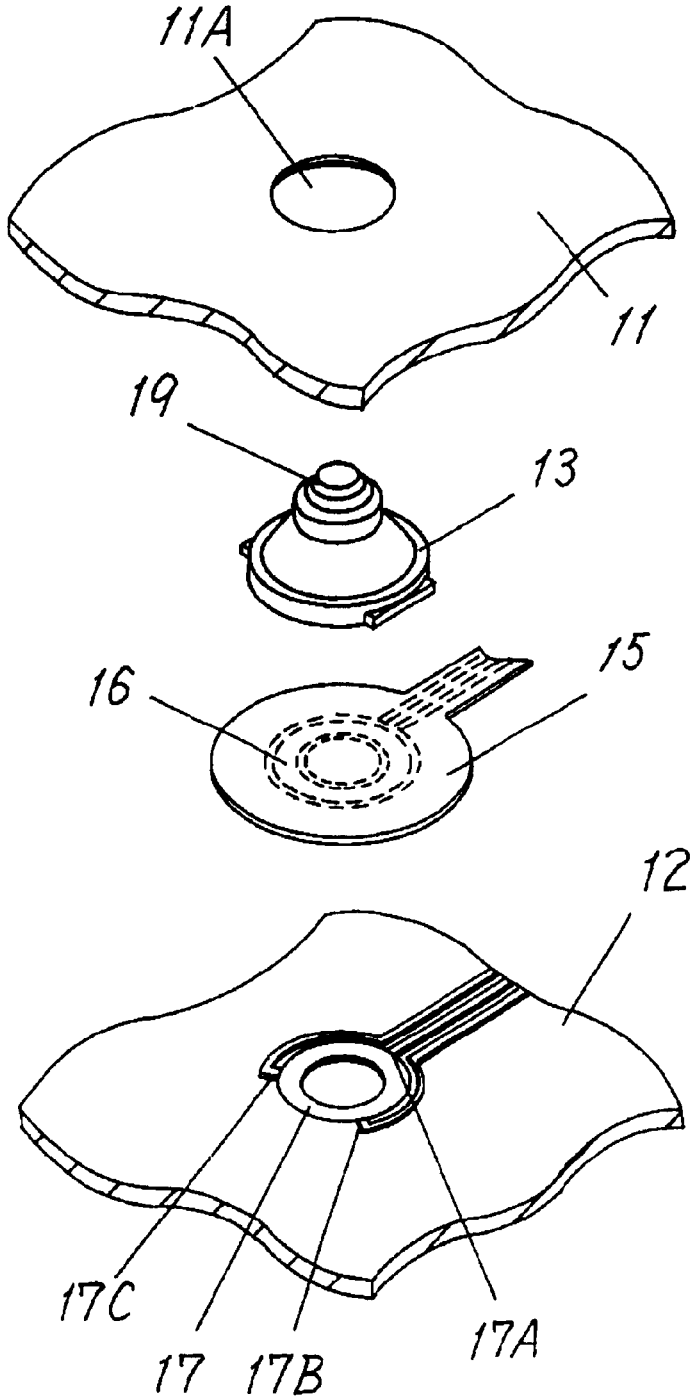
FIG. 2 is an exploded perspective view of the multi-directional input device.
Figure 3:
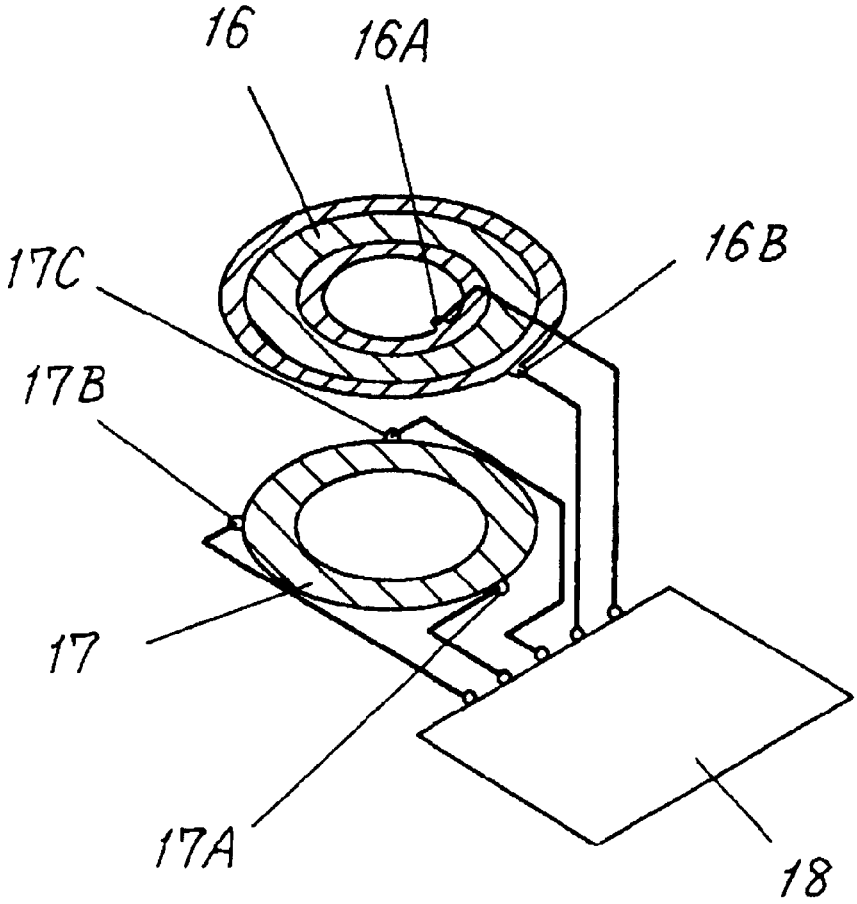
FIG. 3 is a schematic view illustrating a structure of the multi-directional input device.

FIG. 1 is a sectional view of an essential part of electronic equipment using a multi-directional input device in accordance with a first exemplary embodiment of the present invention. FIG. 2 is an exploded perspective view of the part of the multi-directional input device. FIG. 3 is a schematic view illustrating a structure of the multi-directional input device.

With reference to the drawings, the top surface of upper case 11 is an operation surface. Spherical portion 13F of elastic driver 13 is fitted in circular hole 11A in the center of the upper case. Driving knob portion 19 of elastic driver 13 projects from circular hole 11A. Flexible insulated substrate 15 is disposed above planar wiring board 12 so as to provide a predetermined insulation gap and sandwich spacer 14A therebetween. As shown in FIG. 2, circular-ring-like upper resistor layer 16 having a predetermined width is printed on the bottom face of flexible insulated substrate 15. Upper resistor layer 16 has a uniform specific resistance. Lead 16A and lead 16B of upper resistor layer are in electrical continuity with the entire inner circumference and the entire outer circumference of upper resistor layer 16, respectively. Printed in a position on wiring board 12 opposite to upper resistor layer 16 is circular-ring-like lower resistor layer 17 having a diameter and width substantially identical with those of upper resistor layer 16. Lower resistor layer 17 has a uniform specific resistance smaller than that of upper resistor layer 16. Three leads 17A, 17B, and 17C of lower resistor layer 17 are located so as to substantially equally divide lower resistor layer 17 into three parts.

As shown in FIG. 3, two leads 16A and 16B of upper resistor layer 16 and three leads 17A, 17B, and 17C of lower resistor layer 17 are connected to computing unit 18, e.g. a microcomputer (herein after referred to as microcomputer 18) incorporated in this electronic equipment, via respective wiring parts. Elastic driver 13 is mounted on flexible insulated substrate 15. In the elastic driver, disk-like elastic pressing portion 13B supported by elastic thin cylinder portion 13A and center projection 13E is opposed to the backside of upper resistor layer 16 with a predetermined clearance. Elastic pressing portion 13B is like a disk that has outer peripheral edge forming squared step 13C. The outer diameter of the pressing portion 13B is larger than the diameter measured at the center of the width of upper resistor layer 16, and smaller than the outer diameter thereof. The elastic driver has circular step 13D that is projected downwardly from the surface of elastic pressing portion 13B in a position slightly inside of the inner diameter of upper resistor layer 16. At the center of the elastic driver, center projection 13E further projected downwardly is provided. Thus, the bottom face of elastic driver 13 forms a concentric disk of three steps. On the other hand, the upper part of elastic driver 13 forms spherical portion 13F covering entire parts of the top face of elastic pressing portion 13B. The spherical portion is engaged in circular hole 11A through upper case 11 serving as a top cover. In the center of the spherical portion, columnar driving knob portion 19 is provided. Spacer 14B of a rigid body is provided inside of upper resistor layer 16 on flexible insulated substrate 15 and of lower resistor layer 17 on wiring board 12. The part of a multi-directional input device of this embodiment in electronic equipment using the multi-directional input device is structured as above.

Described next are actions of the multi-directional input device structured as above made when an input operation is performed thereon.

Figure 4:
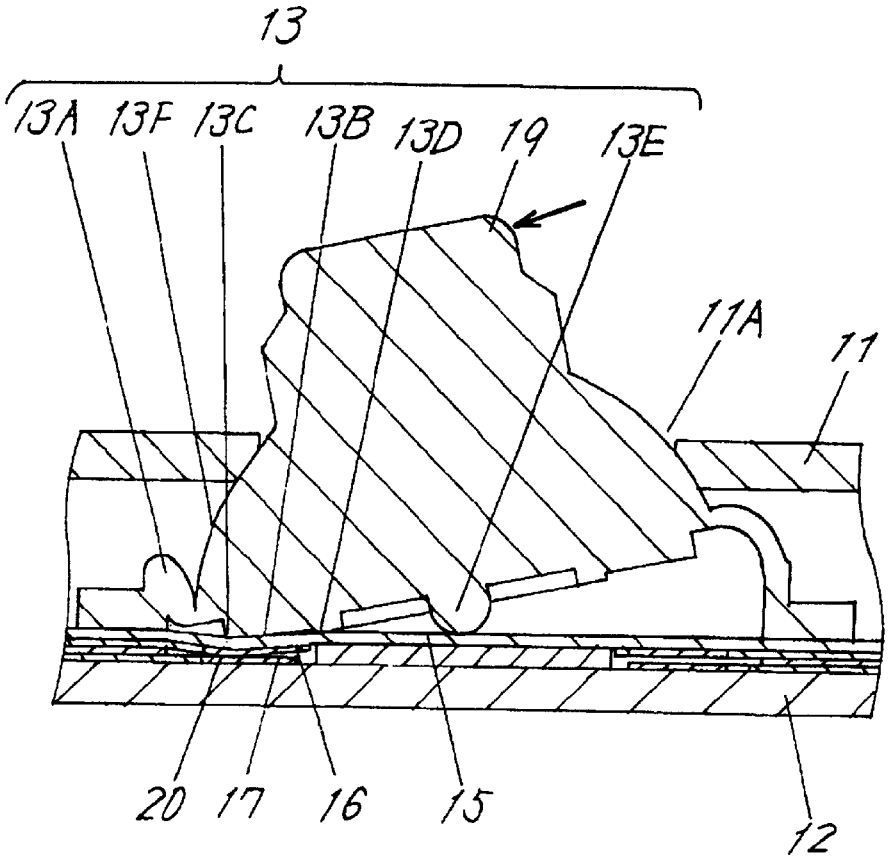
FIG. 4 is a sectional view of an essential part of the multi-directional input device showing an action thereof made when an elastic driver thereof is tilted.
Figure 5:
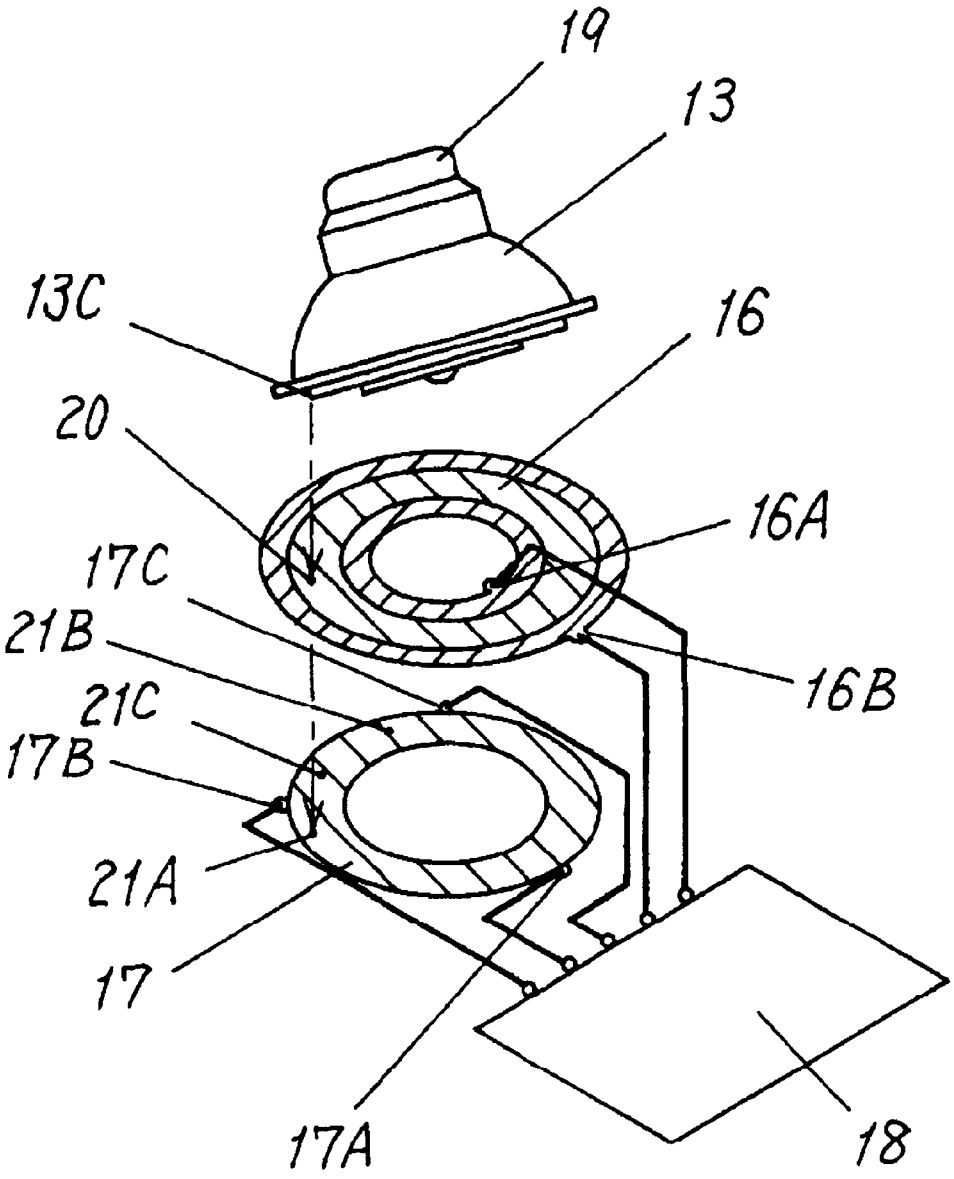
FIG. 5 is a schematic view of the multi-directional input device illustrating a method of recognizing a direction in which the elastic driver is tilted.

The tip of driving knob portion 19 of elastic driver 13 is depressed in an obliquely downward direction in an ordinary state shown in FIG. 1, as shown by the arrow in FIG. 4 which is a sectional view of an essential part illustrating an operational state. Then, spherical portion 13F of elastic driver 13 rotates along the edge of circular hole 11A through upper case 11 around a fulcrum at center projection 13E, and elastic driver 13 tilts in a desired direction at a desired angle while elastic thin cylinder portion 13A elastically deforms. As a result, elastic pressing portion 13B in the tilt direction moves downwardly and squared step 13C along outer peripheral edge thereof depresses and partially and downwardly warps flexible insulated substrate 15. This action brings a part of upper resistor layer 16 on the bottom face of the insulated substrate, i.e. contact point 20, into contact with a part of resistor layer 17. In this state, the outer periphery of circular step 13D also makes contact with flexible insulated substrate 15 on spacer 14B. The depressing force applied to driving knob portion 19 in order to tilt elastic driver 13 is maximized in this position. FIG. 5 is a schematic view for illustrating a recognition method in this state. With reference to this drawing, first, lead 17A of lower resistor layer 17 is grounded (0 V), a DC voltage (e.g. 5 V) is applied to lead 17B, and lead 17C is opened, as a first recognition condition by microcomputer 18. At this condition, a voltage output at lead 16A (or 16B) of upper resistor layer 16 is read, and compared with pre-stored data by microcomputer 18. These operations provide first data: the position of contact point 20 corresponds to point 21A located between leads 17A and 17B and opposite to lead 17C, or to point 21B on the side of lead 17C. Next, lead 17B is grounded (0 V), a predetermined DC voltage (e.g. 5 V) is applied to lead 17C, and lead 17A is opened, as a second recognition condition. At this condition, a voltage output at lead 16A (or 16B) is read, and compared with pre-stored data by microcomputer 18. These operations provide second data: the position of contact point 20 corresponds to point 21C located between leads 17B and 17C and opposite to lead 17A, or to point 21A on the side of lead 17A. Then, microcomputer 18 compares the first data and the second data, recognizes point 21A which is common to both data as the tilt direction, and generate a signal showing the direction.

Figure 6:
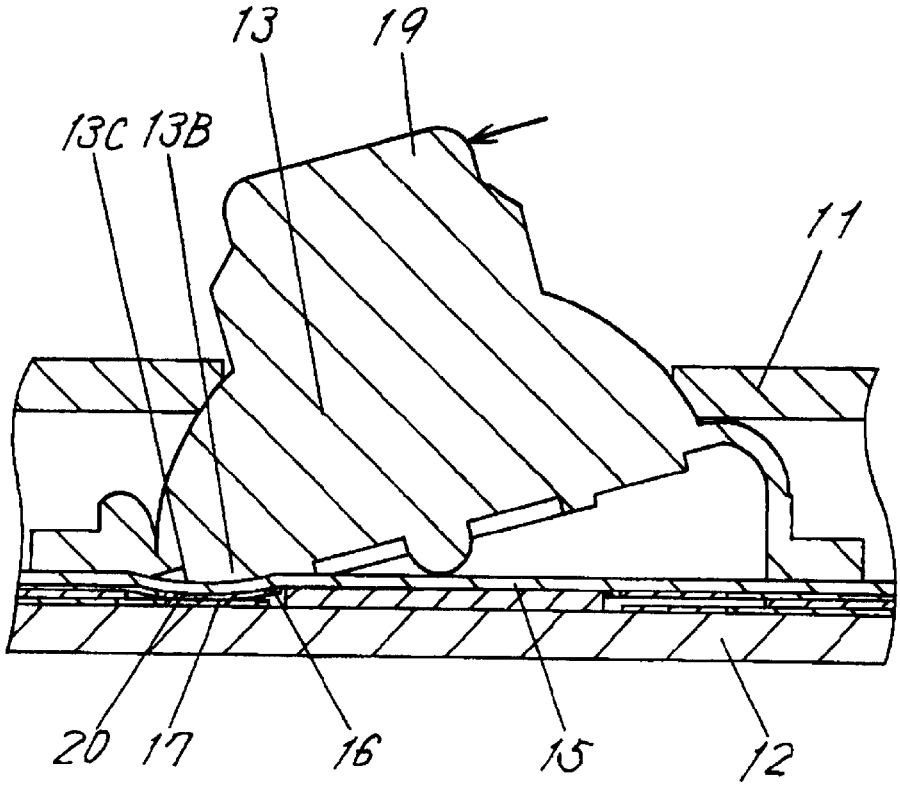
FIG. 6 is a sectional view of an essential part of the multi-directional input device showing an action thereof made when the elastic driver is further tilted.

Next, in a state shown in FIGS. 4 and 5, voltage is applied across leads 16A and 16B of the inner and outer circumferences of upper resistor layer 16, as a recognition condition different from those described above by microcomputer 18. When lead 16B of the outer circumference is grounded (0 V), a DC voltage is applied to lead 16A of the inner circumference, a voltage output at one of the leads of lower resistor layer 17 (e.g. lead 17B nearest to contact point 20) is read, and compared with pre-stored data by microcomputer 18. These operations provide data showing a pressure at which elastic pressing portion 13B depresses flexible insulated substrate 15, i.e. an angle at which elastic driver 13 is tilted. Depressing the tip of driving knob portion 19 more strongly in the state shown in FIG. 4 more largely tilts elastic driver 13, elastically deforms the bottom face thereof, thereby increasing the area in which elastic pressing portion 13B depresses flexible insulated substrate 15. This state is shown in FIG. 6 which is a sectional view of an essential part of the input device. As shown in the drawing, the area in which elastic pressing portion 13B of elastic driver 13 depresses flexible insulated substrate 15 increases in the direction from squared step 13C along the outer peripheral edge of elastic pressing portion 13B to the center. Accordingly, the area in which upper resistor layer 16 is in contact with lower resistor layer 17 spreads in the direction from contact point 20 at which the two layers are brought into contact first to the center.

In this state, voltage is applied by microcomputer 18 across leads 16A and 16B of the outer and inner circumferences of upper resistor layer 16 in a manner similar to the above. When lead 16B of the outer circumference is grounded (0 V) and a DC voltage is applied to lead 16A of the inner circumference, a voltage output at one of the leads of lower resistor layer 17 (17B) is read, and compared with pre-stored data by microcomputer 18. These operations provide data showing a pressure at which elastic pressing portion 13B strongly depresses flexible insulated substrate 15, i.e. an angle at which elastic driver 13 is largely tilted. The area of the contact portion including contact point 20 is larger than that in the above-mentioned case. In other words, the area in which upper resistor layer 16 having a larger specific resistance makes contact with lower resistor layer 17 having a smaller specific resistance is increased. Thus, the voltage output at one of leads (17B) of lower resistor layer 17 is increased by this increased area. The data value obtained corresponds to an angle at which elastic driver 13 is largely tilted.

When the tip of this driving knob portion 19 is depressed strongly to tilt elastic driver 13 largely, spherical portion 13F on the top face thereof is engaged in circular hole 11A through upper case 11. This structure prevents elastic driver 13 from deflecting laterally. The area in which upper resistor layer 16 is in contact with lower resistor layer 17 spreads also in an arc direction. However, since upper resistor layer 16 has a larger specific resistance than lower resistor layer 17, there is only little influence of contact area spread in the arc direction on the voltage output at one of the leads (e.g. 17B) of lower resister layer 17, if contact point 20 is substantially in the center of the spread arc.

In addition, in the above-mentioned method of recognizing a tilt angle of elastic driver 13, lead 16B of the outer circumference of upper resistor layer 16 is grounded (0 V) and a DC voltage is applied to lead 16A of the inner circumference thereof. This is because a larger tilt angle of elastic driver 13 increases the area in which upper resistor layer 16 is in contact with lower resistor layer 17, in the direction from the outer circumference side to the inner circumference side of upper resistor layer 16. Thus, applying DC voltage in the above-mentioned manner can reduce output voltage when the tilt angle is small and contact between both layers is unstable. As a result, unstable areas are eliminated and large output voltages at stable points can be measured and computed to recognize a tilt angle of elastic driver 13.

In addition, because these data acquisition and processing are performed when output voltage reaches a predetermined voltage, and repeated at high speed, accurate recognition can be performed. After the input operations performed in the above-mentioned manner, depressing force applied to the tip of driving knob portion 19 is removed. Then, elastic thin cylinder portion 13A is restored to its original shape by elastic restoring force of its own, and thus elastic driver 13 is returned to its original state shown in FIG. 1. Flexible insulated substrate 15 restores to its original planar state, and thus upper resistor layer 16 and lower resistor layer 17 returns to the opposite state.

In the above description, lower resistor layer 17 printed on wiring board 12 has three leads 17A, 17B, and 17C spaced at a substantially equal angle. Described next is an input operation in a case where lower resistor layer 22 has four leads 22A, 22B, 22C, and 22D spaced at substantially an equal angle, as shown in a schematic view of FIG. 7. The tip of driving knob portion 19 of elastic driver 13 is depressed in an obliquely downward direction to bring a part of upper resistor layer 16, i.e. contact point 23, into contact with a part of lower resistor layer 22. This operation is the same as that in the above-mentioned case.

Figure 7:
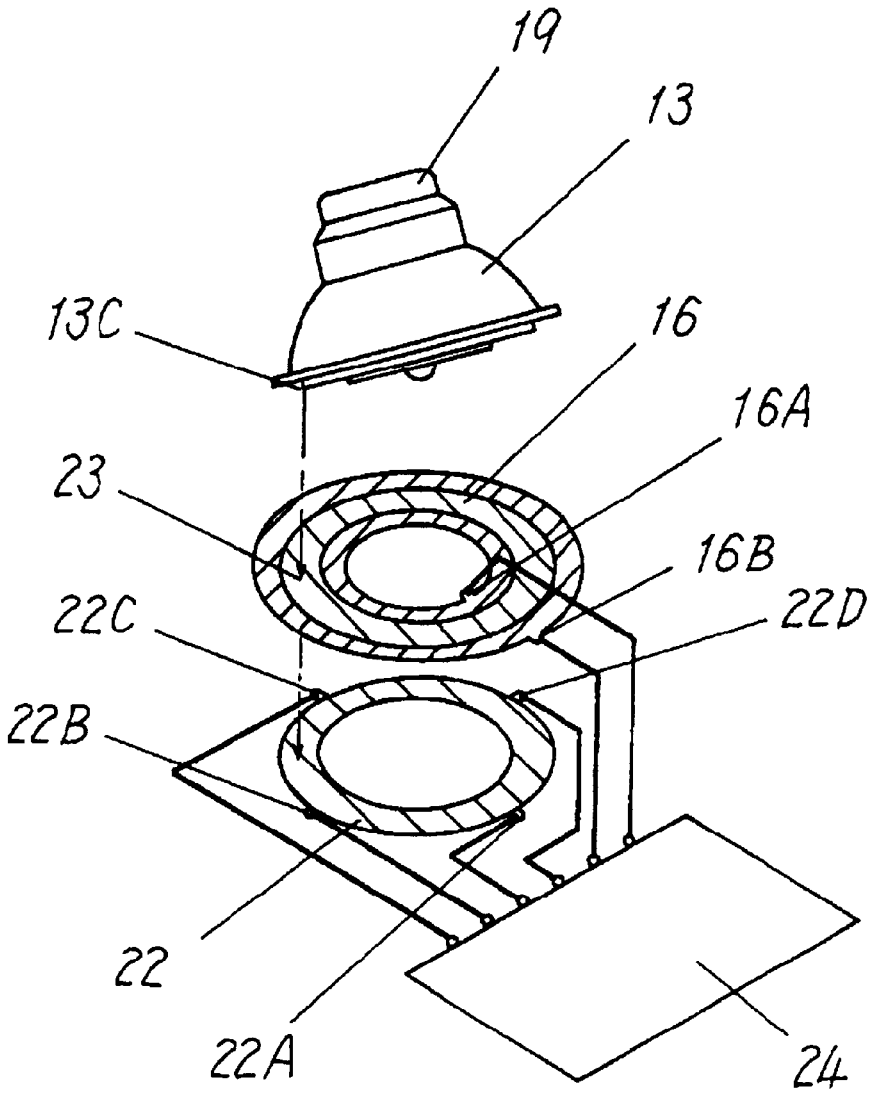
FIG. 7 is a schematic view of another structure of the multi-directional input device.

With reference to FIG. 7, leads 22A and 22C of lower resistor layer 22 are opened, lead 22B is grounded (0 V), and a DC voltage is applied to lead 22D, as a first recognition condition by microcomputer 24. At this condition, a voltage output at lead 16A (or 16B) of upper resistor layer 16 is read and computed by microcomputer 24. These operations provide the X coordinate of contact point 23 as first data.

Next, leads 22B and 22D are opened, lead 22C is grounded, and a DC voltage is applied to lead 22A, as a second recognition condition. At this condition, a voltage output at lead 16A (or 16B) of upper resistor layer 16 is read and computed. These operations provide the Y coordinate of contact point 23 as second data. Then, microcomputer 24 recognizes the X and Y coordinates obtained from the combination of the first and second data as the tilt direction, and generates a signal thereof. With a multi-directional input device of such a structure, relatively simple processing allows recognition at high resolution and input in a large number of directions.

As mentioned above, the multi-directional input device of this embodiment recognizes tilt directions and angles of elastic driver 13, using output voltages at respective leads. The output voltages are a plurality of data that have been obtained under a plurality of recognition conditions when elastic driver 13 of the electronic component for multi-directional input tilts. Thus, some directions in which input operations can be performed according to tilt angles are added to tilt directions in which a large number of input operations can be performed at high resolution. As a result, input operations can be performed in an extremely large number of directions in total. In other words, a multi-directional input device having an extremely high resolution of input directions and electronic equipment using the device can be realized.

Figure 8:
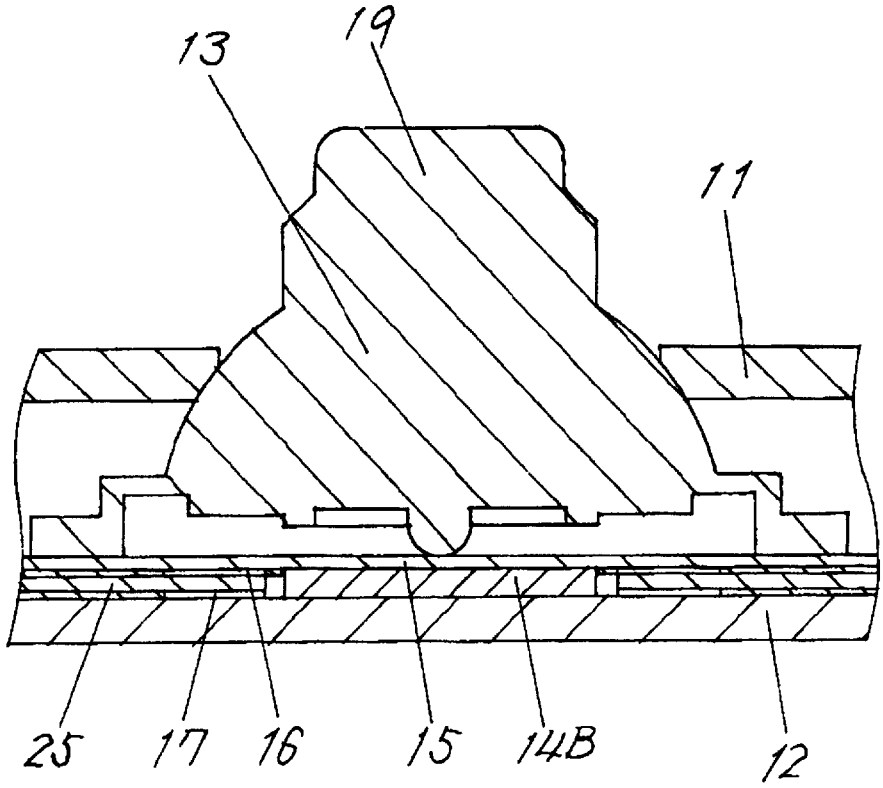
FIG. 8 is a sectional view of an essential part of the multi-directional input device, which has a conductive plate between an upper resistor layer and a lower resistor layer thereof.

In the above description, upper resistor layer 16 on the bottom face of flexile insulated substrate 15 are opposed to lower resistor layer 17 on wiring board 12 so as to sandwich spacer 14A and provide a predetermined clearance therebetween, in an ordinary state. The multi-directional input device can be structured so that conductive plate 25 is interposed therebetween, as shown in a sectional view of an essential part of a multi-directional input device of FIG. 8. This conductive plate 25 is planar and made of a pressure-sensitive electric conductor. In the pressure-sensitive electric conductor, thickness-wise depressing operation establishes electrical continuity between upper and lower layers in the depressed position. The conductive plate is sandwiched between upper resistor layer 16 and lower resistor layer 17 including the surroundings thereof. The structure of other parts, e.g. spacer 14B of a rigid body disposed inside of upper resistor layer 16 and lower resistor layer 17 of this multi-directional input device, is the same as that of the above-mentioned case.

Figure 9:
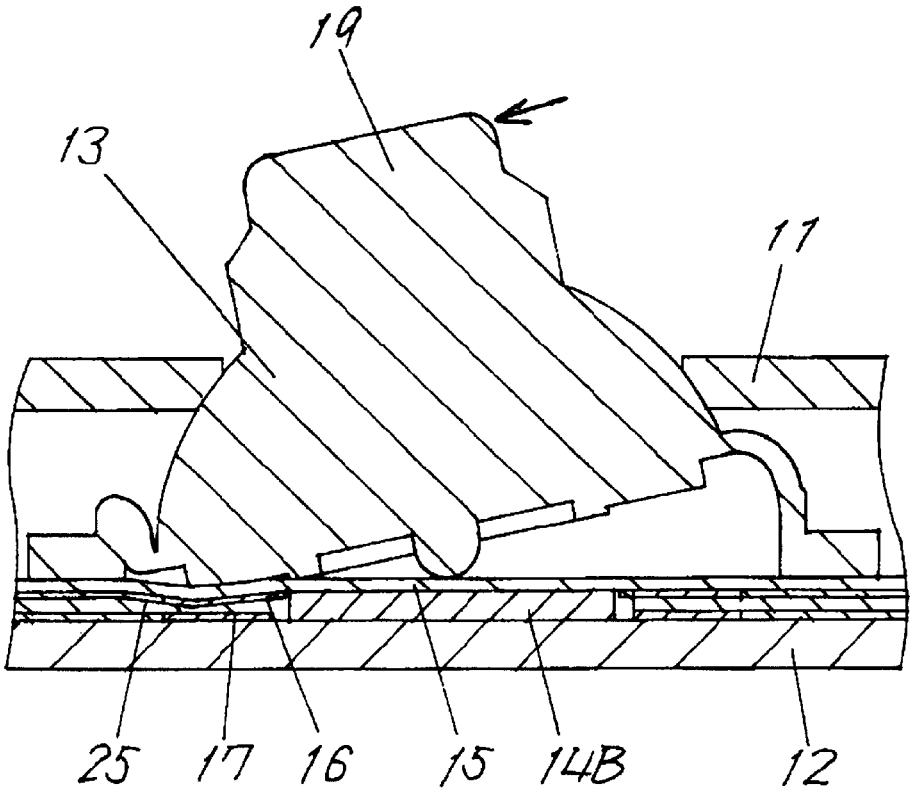
FIG. 9 is a sectional view of an essential part of the multi-directional input device illustrating an action thereof made when the elastic driver in FIG. 8 is tilted.

As shown by the arrow in FIG. 9 which is a sectional view of an essential part of the multi-directional input device, the tip of driving knob portion 19 of elastic driver 13 thereof is depressed in an obliquely downward direction. Then, elastic driver 13 tilts, and the tilt direction and the tilt angle of the elastic driver13 can be recognized from the output voltages at respective leads of upper resistor layer 16 and lower resistor layer 17 obtained under a plurality of detection conditions. This operation and recognition method is the same as those in the above-mentioned case. Such a structure using conductive plate 25 ensures a predetermined insulation gap between upper resistor layer 16 and lower resistor layer 17 and establishes electrical continuity between upper and lower layers in a depressed position, whichever position on the backside of upper resistor layer 16 is depressed. Therefore, the diameter and width of upper resistor layer 16 and lower resistor layer 17 sandwiching the conductive plate, and elastic pressing portion 13B of elastic driver 13 can be reduced, and the multi-directional input device can be downsized accordingly.

Figure 10:
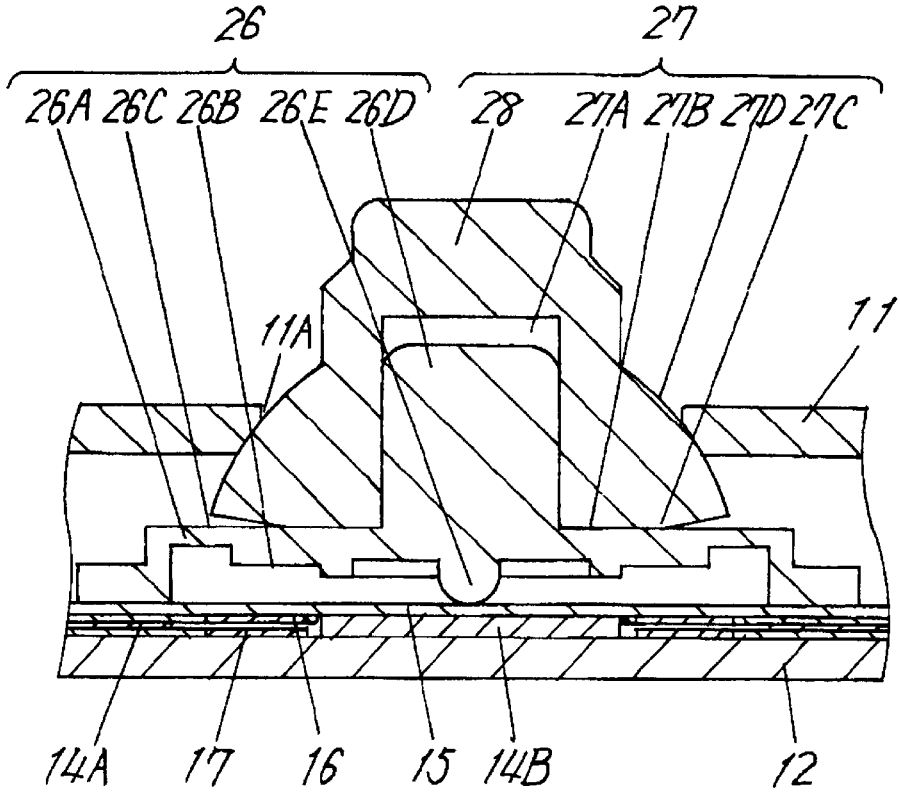
FIG. 10 is a sectional view of an essential part of the multi-directional input device, in which an elastic driver has a manipulation knob attached thereto.

In the above description, elastic driver 13 is integrally formed with driving knob portion 19. However, these elements can be made separately and manipulation knob 27 can be attached to the top of elastic driver 26. FIG. 10 is a sectional view of an essential part of a multi-directional input device having such a structure. Elastic driver 26 has, on the bottom face thereof, disk-like elastic pressing portion 26B that is supported by elastic thin peripheral part 26A along the outer periphery of the elastic driver and center projection 26E so as to be opposed to flexible insulated substrate 15 on the backside of upper resistor layer 16 with a predetermined clearance. This structure is the same as that in the above-mentioned case. However, the elastic driver also has columnar portion 26D in the center of planar top surface 26C. Manipulation knob 27 is fitted to and held by this columnar portion 26D. This manipulation knob 27 is made of a rigid material. Central hole 27A is fitted over columnar portion 26D of elastic driver 26, as described above. The bottom face of surroundings of the central hole forms a disk-like portion having a diameter substantially identical with that of elastic pressing portion 26B of elastic driver 26. Central planar portion 27B of the manipulation knob is in contact with planar top surface 26C of elastic driver 26. However, the bottom face of the manipulation knob gradually floats from angled portion 27C located in a position having a predetermined diameter to the outer peripheral edge of the manipulation knob. Spherical portion 27D in the upper part of manipulation knob 27 is in contact with the edge of through hole 11A through case 11. Provided in the center and at the top of the manipulation knob is columnar driving knob portion 28.

Described are actions of the multi-directional input device structured as above made when an input operation is performed thereon. As shown by the arrow in a sectional view of an essential part of this multi-directional input device of FIG. 11, the tip of driving knob portion 28 of manipulation knob 27 thereof is depressed in an obliquely downward direction. Then, spherical portion 27D rotatably tilts along the edge of circular hole 11A through upper case 11. Manipulation knob 27 tilts elastic driver 26 in a desired direction at a desired angle around a fulcrum at center projection 26E, while elastically deforming elastic thin cylinder portion 26A of elastic driver 26 via columnar portion 26D. As a result, squared step 26F along the outer peripheral edge of the bottom face of elastic pressing portion 26B in the tilt direction depresses and partially and downwardly warps flexible insulated substrate 15. A part of upper resistor layer 16 on the bottom face of the substrate, i.e. contact point 20, is brought into contact with a part of lower resistor layer 17. The tilt direction and the tilt angle of manipulation knob 27 can be recognized according to the output voltage of each of leads of upper resistor layer 16 and lower resistor layer 17 obtained under a plurality of conditions. These actions and method of recognition are the same as those in the above-mentioned case.

It is angled portion 27C on the bottom face of manipulation knob 27 located in a position having a predetermined diameter that downwardly pushes planar top surface 26C of elastic driver 26 and depresses squared step 26F along the outer peripheral edge of elastic pressing portion 26B onto flexible insulated substrate 15 when this elastic driver tilts. The part outer than the angled portion floats and does not push planar top surface 26C of elastic driver 26.

Figure 11:
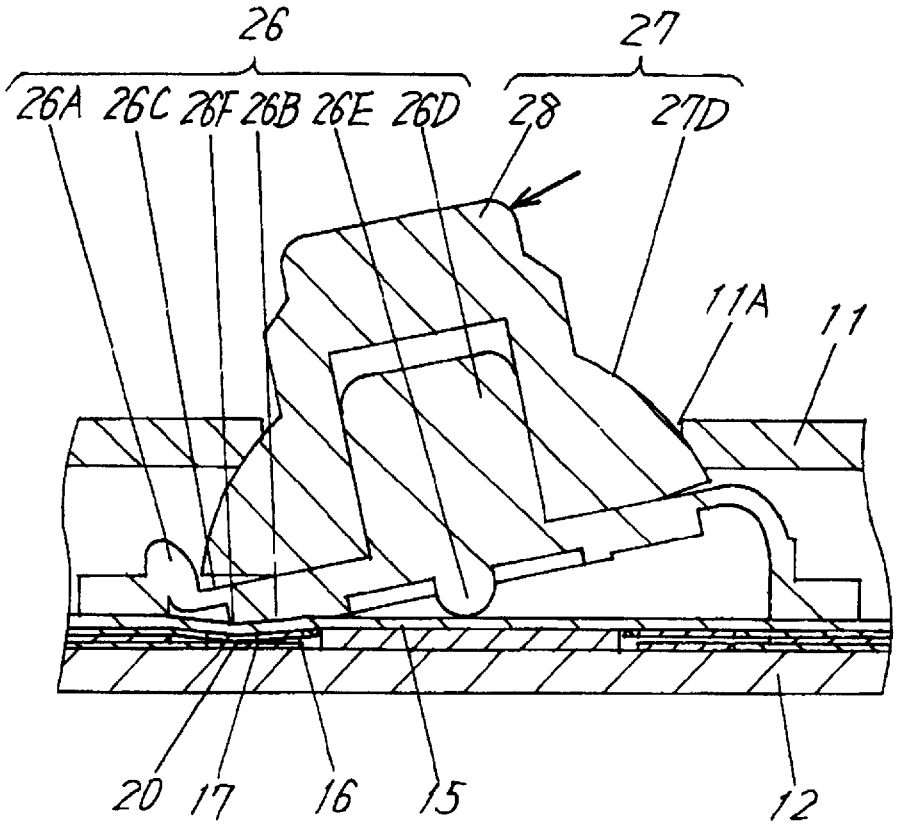
FIG. 11 is a sectional view of an essential part of the multi-directional input device illustrating an action thereof made when the elastic driver in FIG. 10 is tilted.
Figure 12:
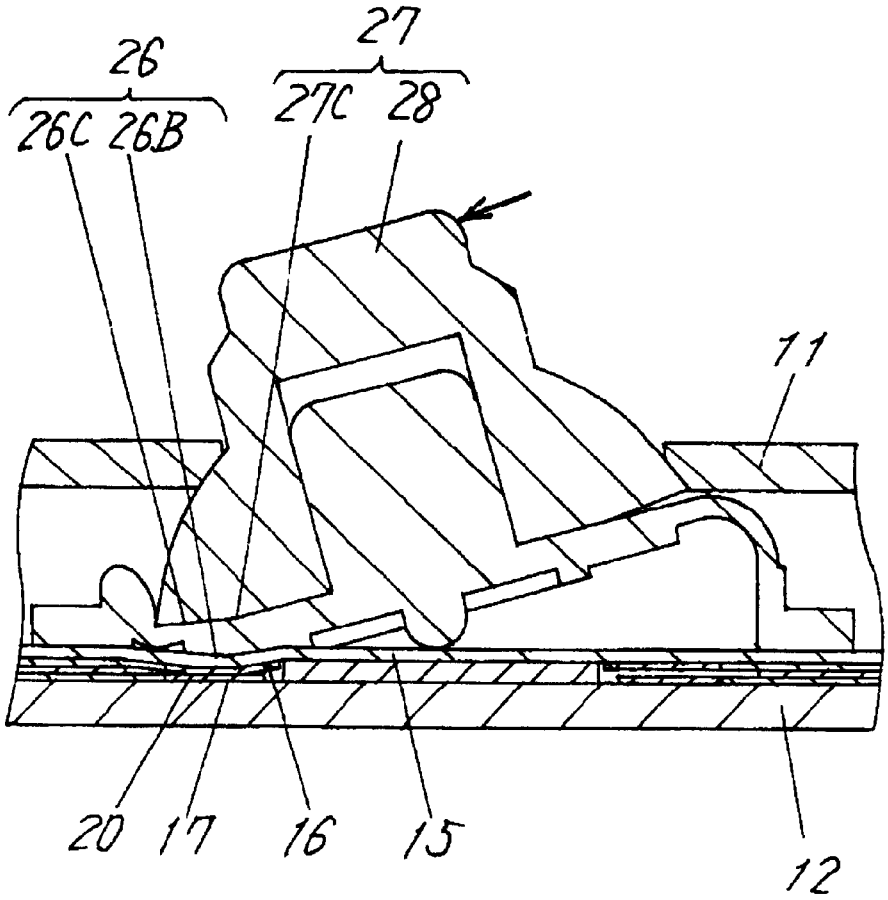
FIG. 12 is a sectional view of an essential part of the multi-directional input device illustrating an action thereof made when the elastic driver in FIG. 11 is further tilted.

Further strongly depressing the tip of driving knob portion 28 in the position shown in FIG. 11 more largely tilts manipulation knob 27 and elastic driver 26, thereby elastically deforming planar top surface 26C and the bottom face of elastic driver 26. Thus, under angled portion 27C located in a position having a predetermined diameter on the bottom face of manipulation knob 27, elastic pressing portion 26B is depressed in the direction from the outer peripheral portion to the center of elastic pressing portion 26B. The area in which elastic pressing portion 26B depresses flexible insulated substrate 15 increases. This state is shown in FIG. 12 which is a sectional view of an essential part of the input device.

As shown in the drawing, the area in which elastic pressing portion 26B of elastic driver 26 depresses flexible insulated substrate 15 increases in the direction from the outer peripheral edge to the center of elastic pressing portion 26B. The area in which upper resistor layer 16 is in contact with lower resistor layer 17 spreads in the direction from first contact point 20 to the center. These phenomena are the same as those in the above-mentioned case. The structure using such a manipulation knob 27 made of a rigid material can securely increase the area in which elastic driver 26 depresses flexible insulated substrate 15 to bring resistor layer 16 into partial contact with lower resistor layer 17, in the direction of the outer peripheral edge to the center of elastic pressing portion 26, when the tip of manipulation knob 27 is depressed in an obliquely downward direction. In addition, it is easy to change the color of manipulation knob 27 and indicate which operation is to be performed using the manipulation knob.

Figure 13:
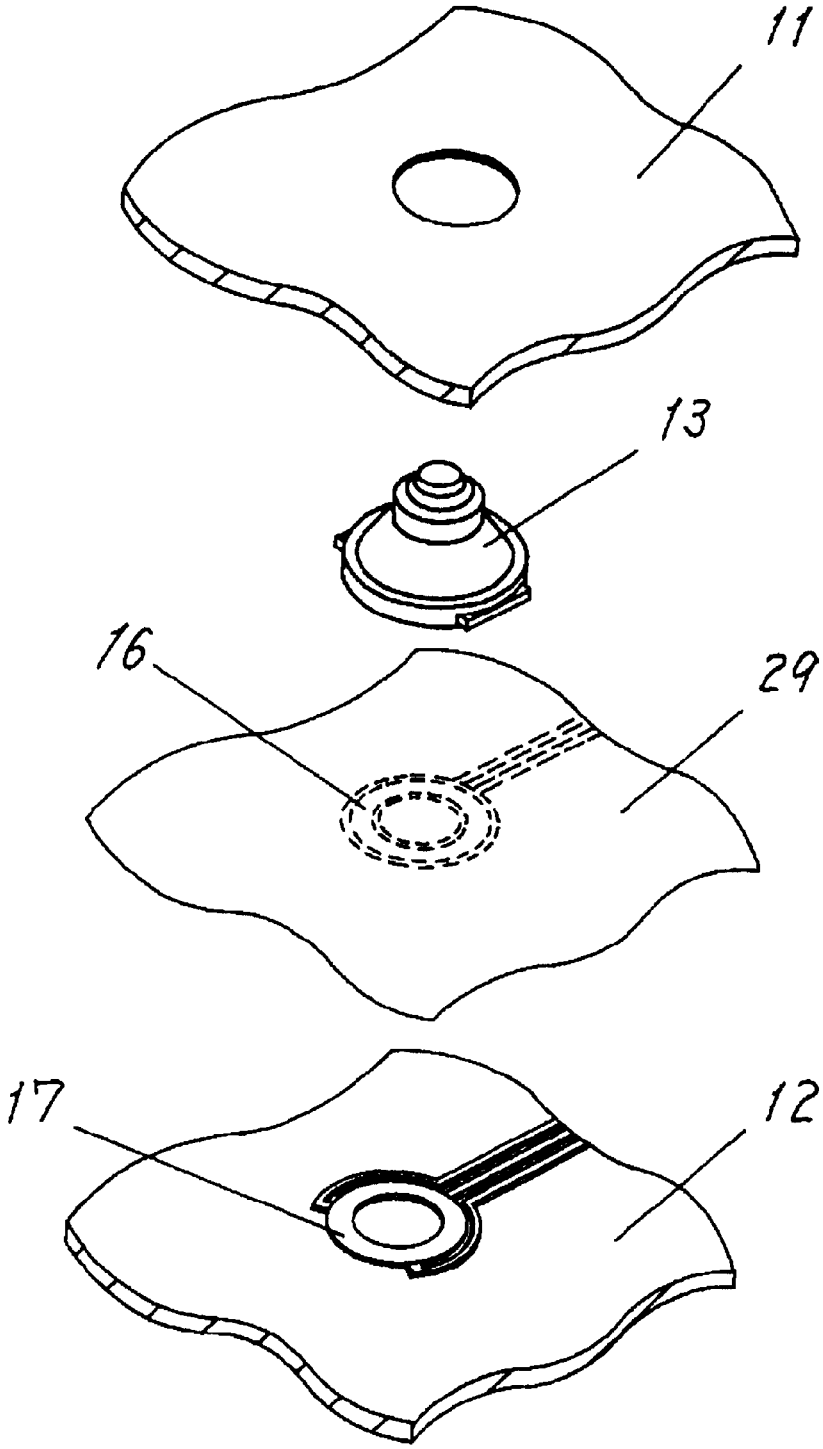
FIG. 13 is an exploded perspective view of another structure of the multi-directional input device.

In the above description, lower resistor layer 17 of the electronic component for multi-directional input is printed on wiring board 12 of the electronic equipment, and upper resistor layer 16 opposed to the lower resistor layer is printed on the bottom face of flexible insulated substrate 15 of the electronic component for multi-directional input. However, upper resistor layer 16 can also be formed on the bottom face of flexible wiring board 29 that is disposed over wiring board 12 of the electronic equipment. FIG. 13 shows an exploded perspective view of the part of the multi-directional input device structured as above in the electronic equipment. Such a structure can reduce the number of constituent components in entire electronic equipment using a multi-directional input device and thus man-hours for assembling, and facilitate wiring from the leads of upper resistor layer 16. Thus, electronic equipment using an inexpensive multi-directional input device can be provided.

(Second Exemplary Embodiment)

Figure 14:
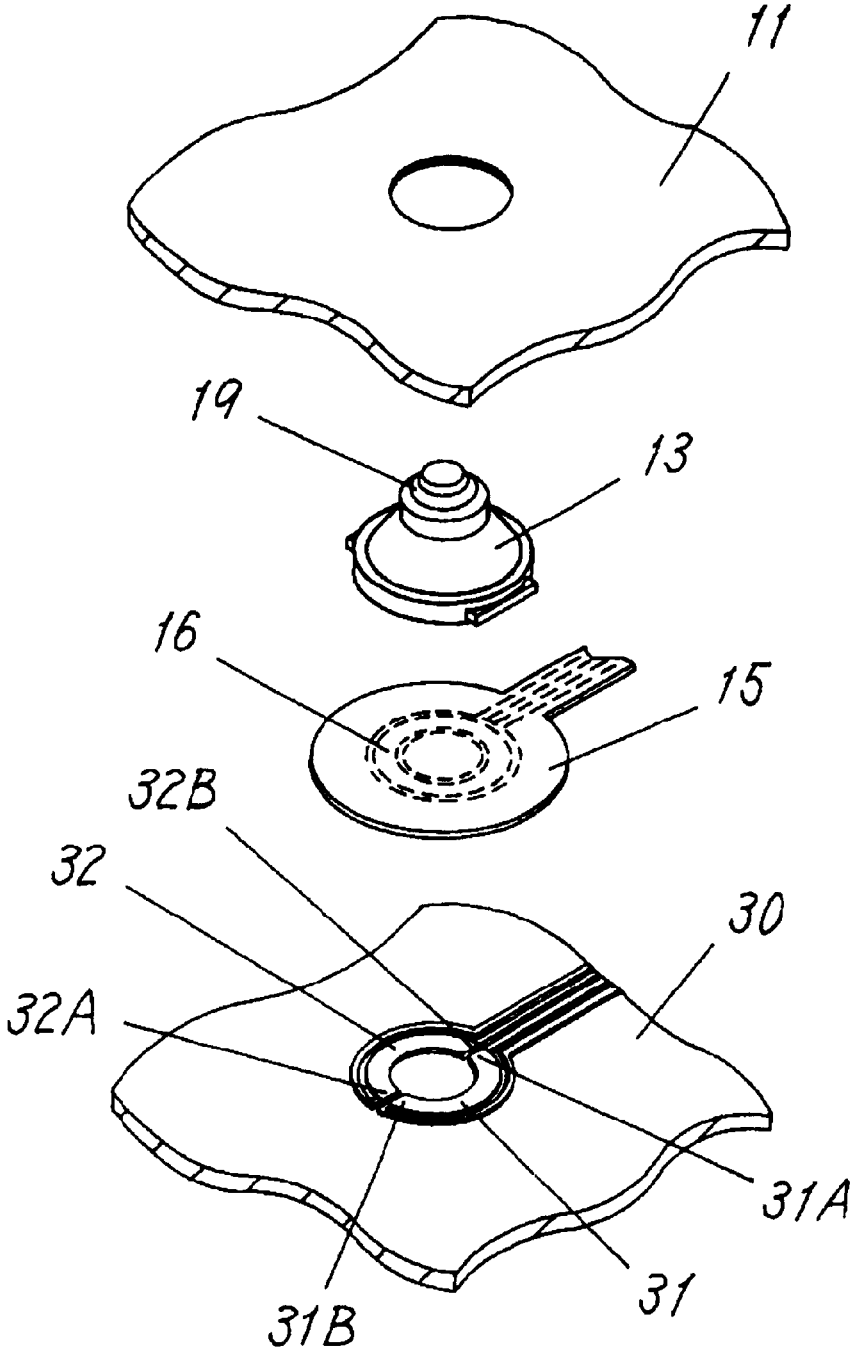
FIG. 14 is an exploded perspective view of a multi-directional input device in accordance with a second exemplary embodiment of the present invention.
Figure 15:
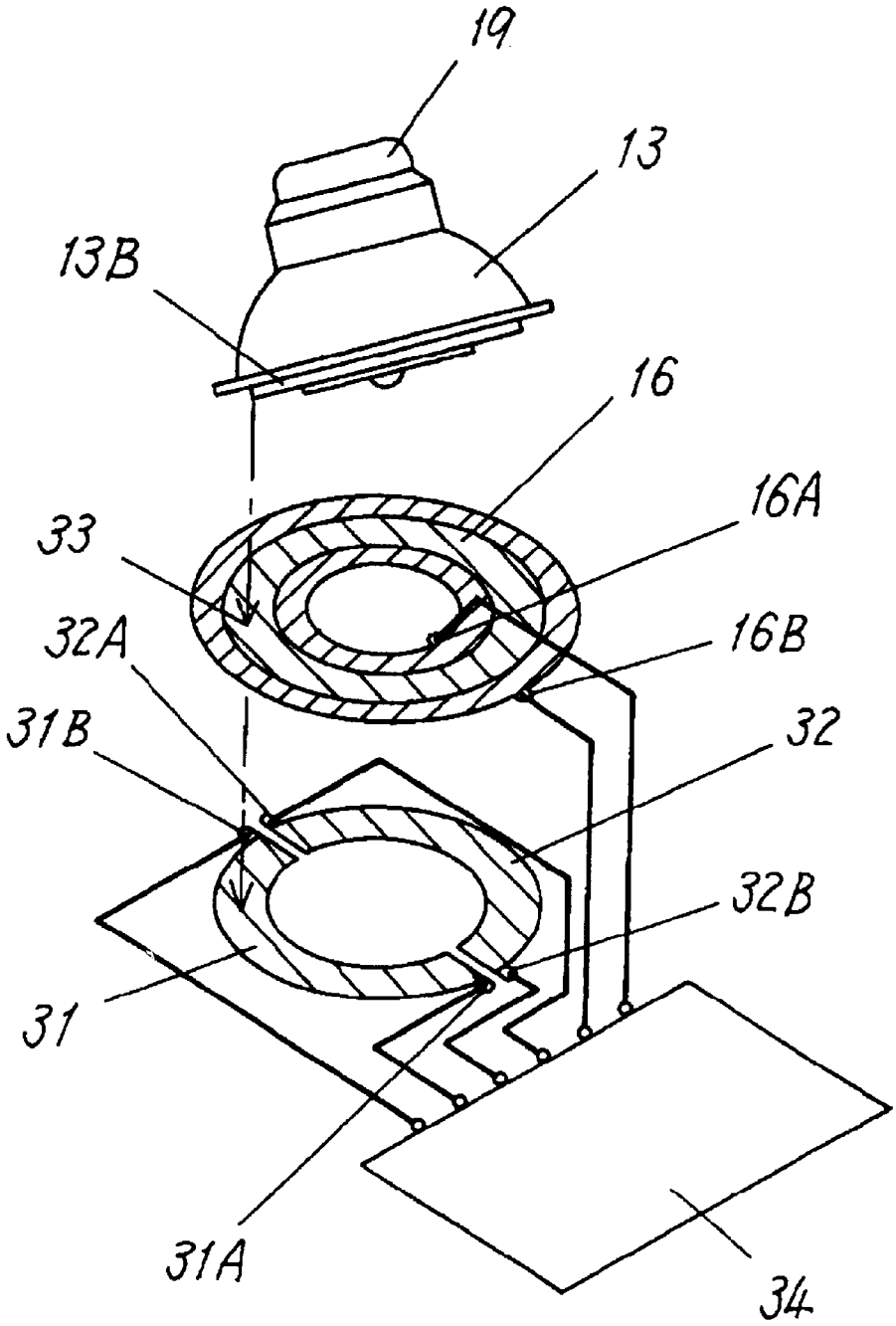
FIG. 15 is a schematic view of the multi-directional input device illustrating a method of recognizing a direction in which an elastic driver is tilted.

FIG. 14 is an exploded perspective view of the part of a multi-directional input device in electronic equipment using the multi-directional input device in accordance with the second exemplary embodiment of the present invention. FIG. 15 is a schematic view thereof illustrating a recognition method in an operational state.

As shown in the drawings, the multi-directional input device of this embodiment is similar to the First Exemplary Embodiment. However, lower conductor layer printed on wiring board 30 of the electronic equipment comprises first resistor layer 31 and second resistor layer 32. These two layers are made of a circular-ring-like resistor layer divided into two parts with a predetermined space and have leads 31A and 31B, as well as 32A and 32B, at each end thereof. The structure of other parts is the same as that of the First Exemplary Embodiment shown in FIG. 2.

Now described are actions of the multi-directional input device made when an input operation is performed. With reference to FIGS. 14 and 15, when the tip of driving knob portion 19 is depressed to tilt elastic driver 13 in a desired direction at a desired angle, the bottom face of the outer peripheral edge of elastic pressing portion 13B in the tilt direction depresses and partially and downwardly warps flexible insulated substrate 15. Then, a part of upper resistor layer 16 on the bottom face of the substrate, i.e. contact point 33, is brought into contact with a part of the lower layer, e.g. first resistor layer 31. The recognition method is described with reference to FIG. 15. First, voltage is applied across leads 31A and 31B at the ends of first resistor layer 31 while lead 31A is grounded (0 V) and a predetermined DC voltage (e.g. 5 V) is applied to lead 31B, as a first recognition condition. At this condition, according to the resistance value between lead 31A and contact point 33, a voltage corresponding to the contact point is output at lead 16A (or 16B) of the above-mentioned resistor layer 16 and transferred to computing unit 34, such as a microcomputer (hereinafter referred to as microcomputer 34).

Next, in a short switching cycle, a predetermined DC voltage is applied across leads 32A and 32B at the ends of second resistor part 32, as a second recognition condition. However, because upper resistor layer 16 is not in contact with second resistor layer 32, no voltage is output at lead 16A of upper resistor layer 16. When elastic driver 13 is tilted in a direction opposite to the above in a similar manner, upper resistor layer 16 makes partial contact with second resistor layer 32. Then, when a predetermined DC voltage is applied across leads 32A and 32B of the second resistor layer, a voltage is output at lead 16A (or 16B) of upper resistor layer 16. In this manner, only when DC voltage is applied to the lower conductor layer corresponding to the direction in which elastic driver 13 is tilted by depression of driving knob portion 19, i.e. first resistor layer 31 or second resistor layer 32, output voltage can be obtained from upper resistor layer 16. Thus, the tilt direction can be recognized by processing the position of lead to which DC voltage applied, and the output voltage by microcomputer 34. The method of recognizing a tilt angle by microcomputer 34 is the same as that in the case of First Exemplary Embodiment, and the descriptions are omitted.

As mentioned above, the multi-directional input device of this embodiment realizes a multi-directional input device and electronic equipment using the device that can recognize tilt directions of elastic driver 13 with simple processing at high resolution.

(Third Exemplary Embodiment)

Figure 16:
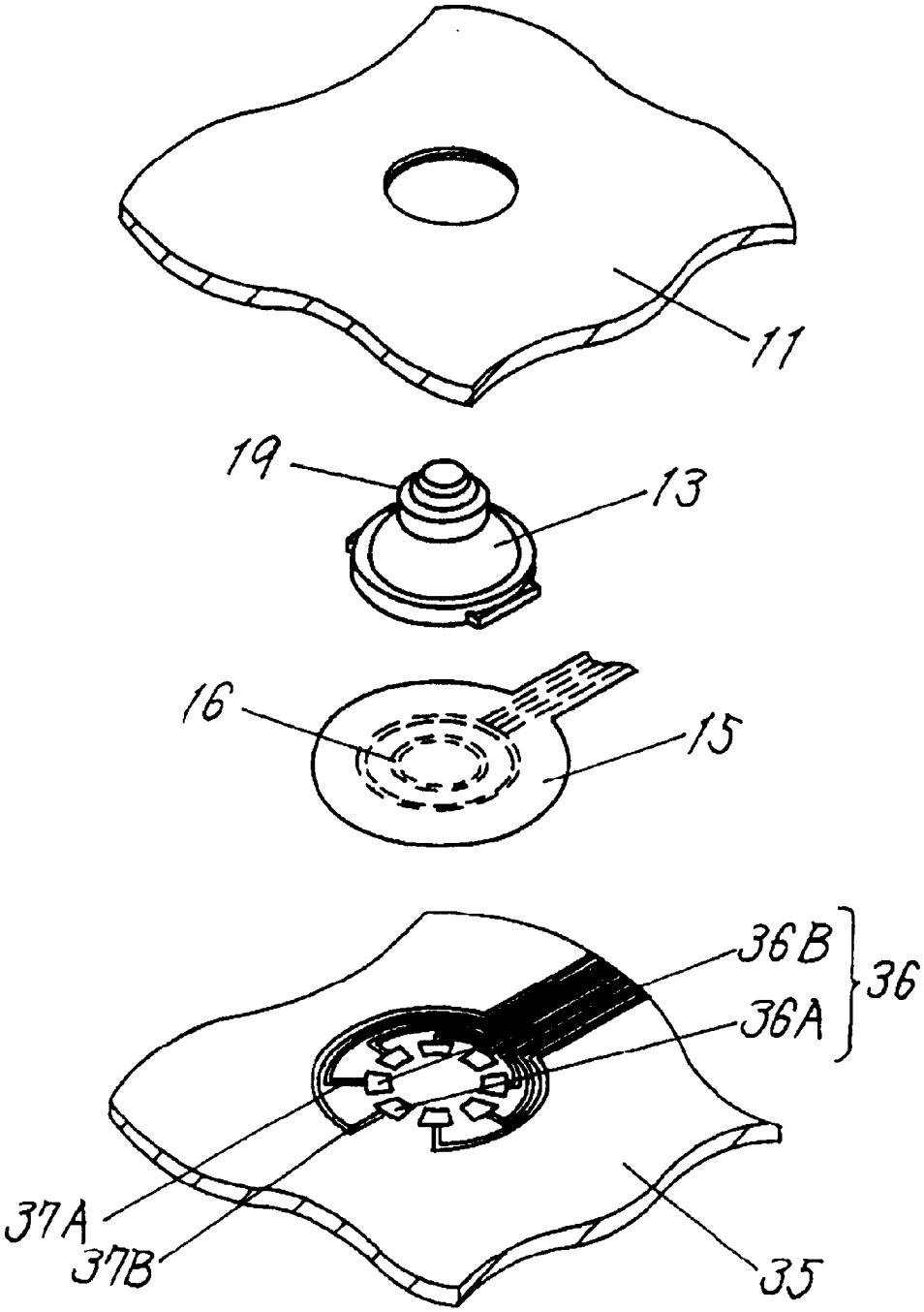
FIG. 16 is an exploded perspective view of a multi-directional input device in accordance with a third exemplary embodiment of the present invention.

FIG. 16 is an exploded perspective view of the part of a multi-directional input device in electronic equipment using the multi-directional input device in accordance with the third exemplary embodiment of the present invention.

As shown in the drawing, the multi-directional input device of this embodiment is similar to the First Exemplary Embodiment. However, circular-ring-like lower conductor layer 36 printed on wiring board 35 of the electronic equipment is divided into parts in a predetermined angular direction and individual conductor layers 36A, 36B, . . . have leads 37A, 37B, . . . , respectively. Each of leads 37A, 37B, . . . are connected to a computing unit, such as a microcomputer (not shown in FIG. 16). The structure of other parts is the same as that of the First Exemplary Embodiment shown in FIG. 2.

Now described are actions of the multi-directional input device made when an input operation is performed thereon. When the tip of driving knob portion 19 is depressed to tilt elastic driver 13, the bottom of the outer peripheral edge of elastic pressing portion 13B (not shown in FIG. 16) in the tilt direction depresses and partially and downwardly warps flexible insulated substrate 15. Then, a part of upper resistor layer 16 on the bottom face of the substrate is brought into contact with a part of lower conductor layer 36, e.g. conductor layer 36A. The direction of conductor layer 36A is already stored in the microcomputer, and thus the direction in which elastic driver 13 is tilted can be recognized easily without any special processing in the microcomputer. The method of recognizing tilt angles of elastic driver 13 is the same as that in the case of the First Exemplary Embodiment, and the descriptions are omitted.

As mentioned above, the multi-directional input device of this embodiment requires a predetermined number of connections to the microcomputer. However, it realizes a multi-directional input device that can accurately recognize directions in which elastic driver 13 is tilted at a predetermined resolution without any special processing.

(Fourth Exemplary Embodiment)

Figure 17:
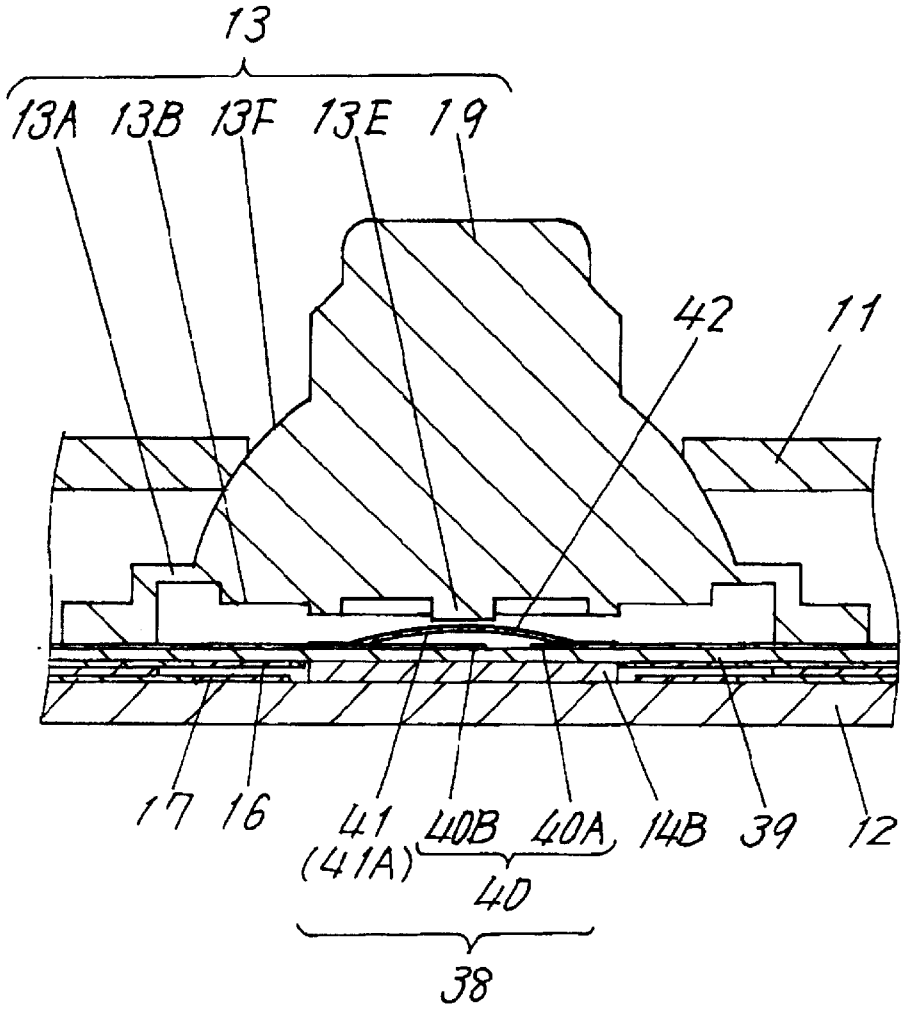
FIG. 17 is a sectional view of an essential part of a multi-directional input device in accordance with a fourth exemplary embodiment of the present invention.
Figure 18:
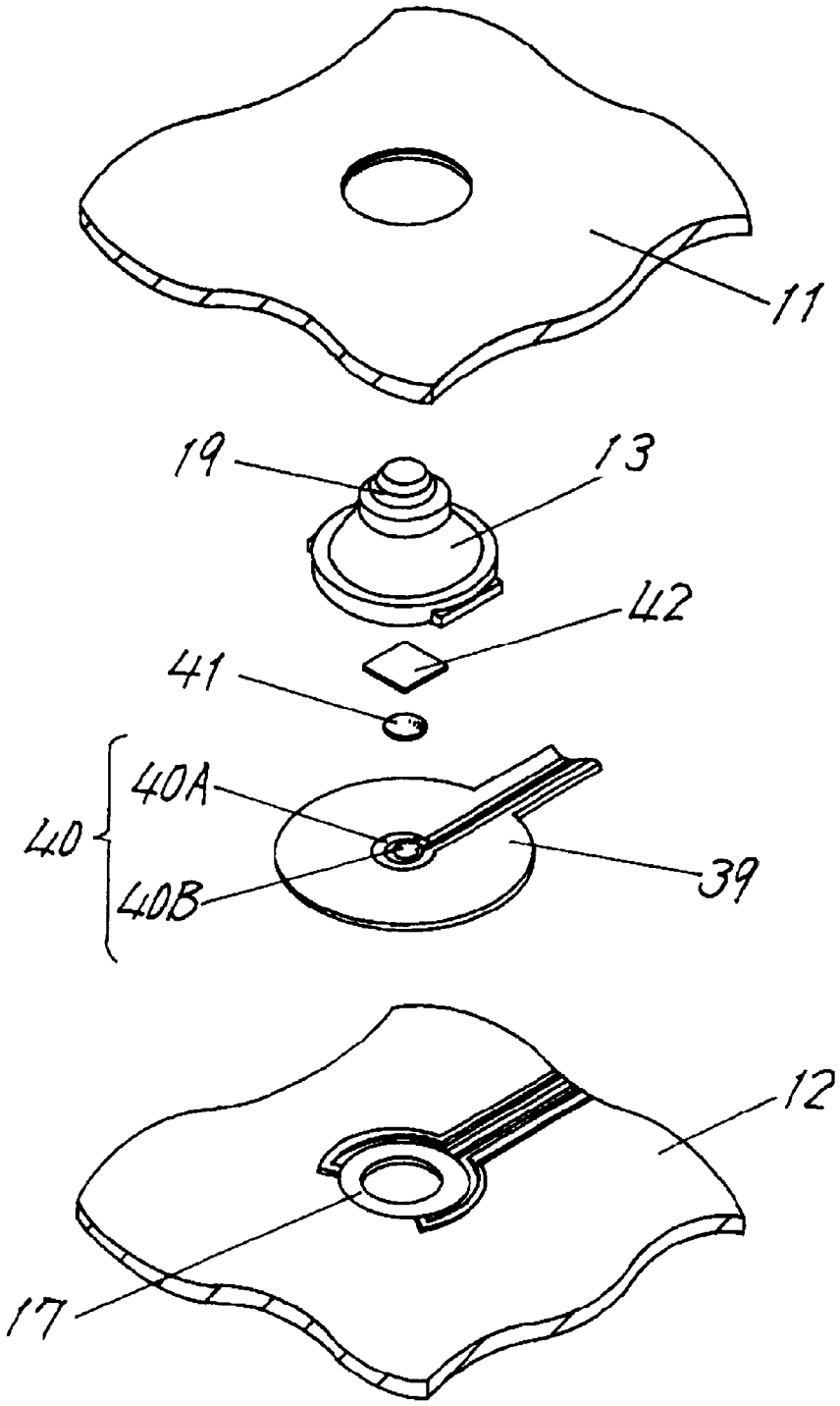
FIG. 18 is an exploded perspective view of the multi-directional input device.

FIG. 17 is a sectional view of an essential part of electronic equipment using a multi-directional input device in accordance with the fourth exemplary embodiment of the present invention. FIG. 18 is an exploded perspective view of the part of the multi-directional input device.

As shown in the drawings, the multi-directional input device of this embodiment is similar to the First Exemplary Embodiment. However, it also has self-restoring press switch 38 actuated by holding down driving knob portion 19 of elastic driver 13. The structure of press switch 38 is described below. On the top face of flexible insulated substrate 39 under driving knob portion 19 of elastic driver 13, fixed contact 40 of the switch comprising outer contact 40A and central contact 40B is formed by printing and other method. Movable contact 41 made of resilient metallic thin plate and shaped to a circular dome is mounted on these contacts so that the outer peripheral bottom edge of the movable contact is on outer contact 40A and the bottom face of central dome 41A is opposed to central contact 40B with a predetermined clearance. The movable contact is adhered to the fixed contacts by flexible tape with adhesive 42. The top face of dome 41A of movable contact 41 is opposed to center projection 13E at the center of the bottom face of elastic driver 13. The structure of other parts is the same as that of the First Exemplary Embodiment shown in FIGS. 1 and 2. For example, circular-ring-like upper resistor layer 16 is printed on the bottom face of flexible insulated substrate 39. Lower resistor layer 17 opposed to the upper resistor layer is printed on wiring board 12. Inside of these upper and lower resistor layers, i.e. under fixed contact 40 of the switch on flexible insulated substrate 39, spacer 14B of a rigid body is disposed.

Figure 19:
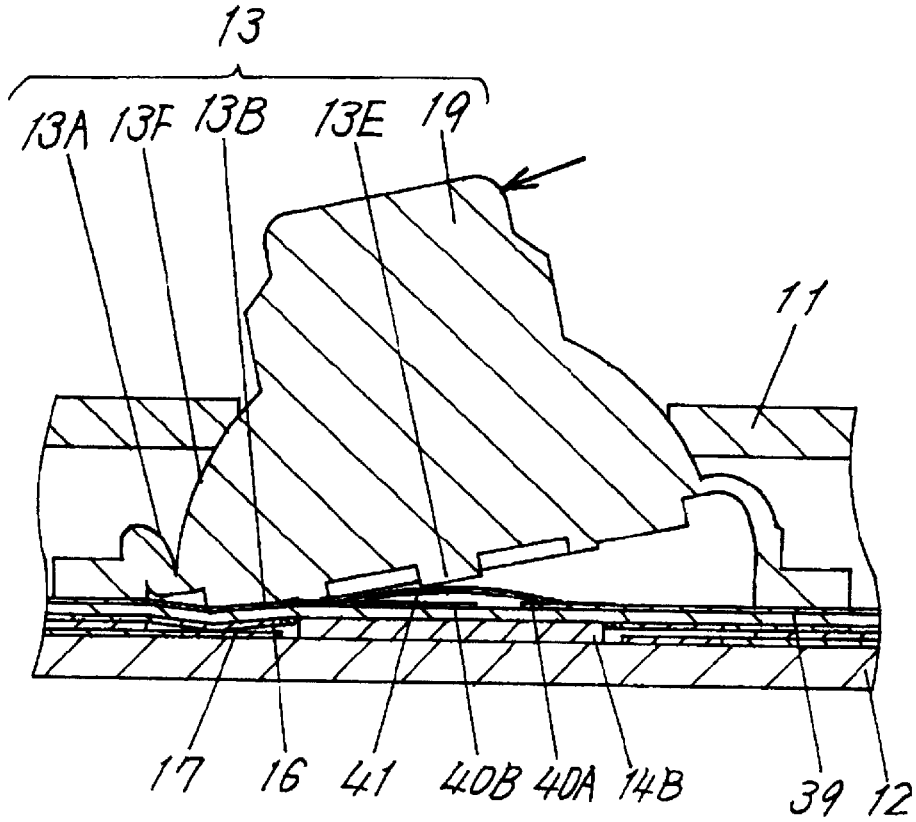
FIG. 19 is a sectional view of an essential part of the multi-directional input device illustrating an action thereof made when an elastic driver is tilted.

Input operation is performed on this multi-directional input device structured as above, by tilting elastic driver 13. An action made at this time is shown in a sectional view of an essential part of the input device of FIG. 19. As shown by the arrow in this drawing, driving knob portion 19 is depressed in an obliquely downward direction to tilt elastic driver 13, thereby depressing and partially and downwardly warping the bottom face of flexible insulated substrate 39 in the tilt direction. Thus, a part of upper resistor layer 16 is brought partial contact with lower resistor layer 17. These actions and the method of recognizing the tilt direction and angle of elastic driver 13 at this time are the same as those of the First Exemplary Embodiment, and the descriptions are omitted. The resilient inverting force of circular-dome-like movable contact 41 is set so that press switch 38 is not actuated in this operation.

Figure 20:
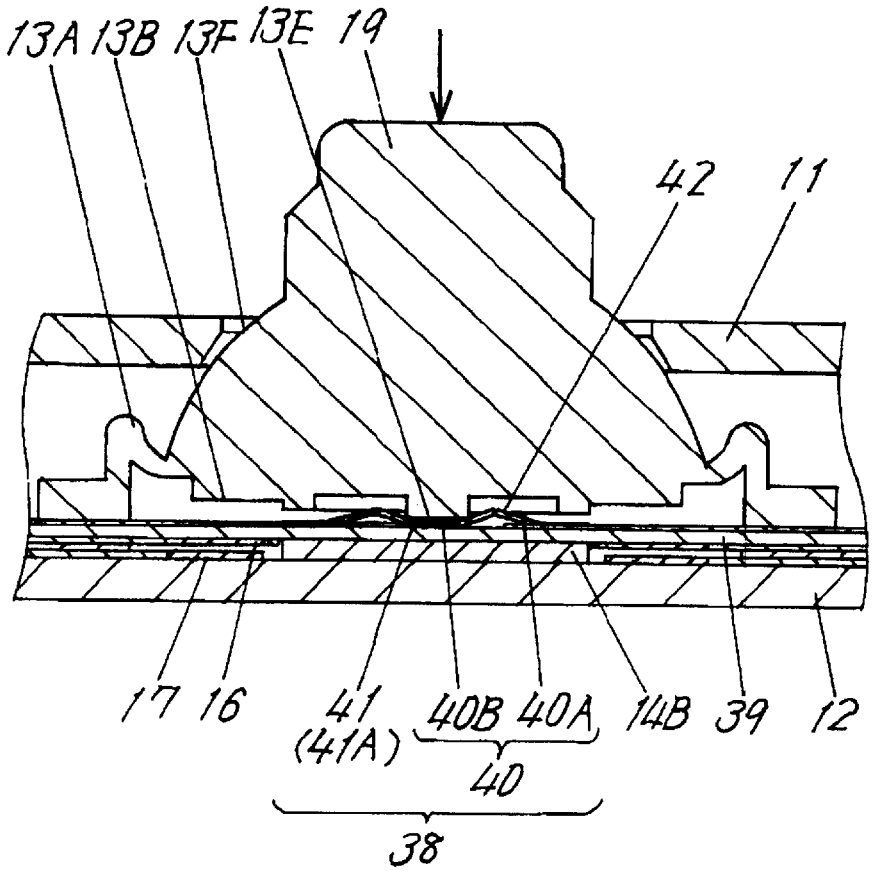
FIG. 20 is a sectional view of an essential part of the multi-directional input device illustrating an action thereof made when the elastic driver is held down.

Next, elastic driver 13 is held down to actuate press switch 38. This state is shown in a sectional view in FIG. 20. As shown by the arrow in the drawing, driving knob portion 19 in the state shown in FIG. 17 is held down. Then, in elastic driver 13, elastic thin cylinder portion 13A elastically deforms along all the periphery thereof, spherical portion 13F leaves upper case 11 and the entire central portion moves downwardly. Center projection 13E at the center of the bottom face depresses the top face of dome 41A of movable contact 41 via tape with adhesive 42. Dome 41A of movable contact 41 that being depressed resiliently turns inside out with positive tactile response. The bottom face of dome 41A makes contact with central contact 40B, thereby short-circuiting outer contact 40A and central contact 40B, i.e. fixed contact 40 of the switch. When the depressing force applied to driving knob portion 19 is removed, elastic thin cylinder portion 13A is restored to its original shape by elastic restoring force of its own, and thus elastic driver 13 is returned to the state shown in FIG. 17. Dome 41A of movable contact 41 of press switch 38 is restored to its original circular dome shape from the inverted state by the resilient restoring force of its own. Outer contact 40A and central contact 40B in fixed contact 40 of the switch are returned to the open state. Elastic pressing portion 13B and center projection 13E on the bottom face of elastic driver 13 are dimensioned so as to prevent elastic pressing portion 13B on the bottom face of elastic driver 13 from depressing flexible insulated substrate 39 and to prevent upper resistor layer 16 from making contact with lower resistor layer 17 when this press switch 38 is actuated.

As mentioned above, the multi-directional input device of this embodiment realizes a multi-directional input device that can generate another signal for determining a direction in which driving knob portion 19, i.e. elastic driver 13, is tilted by depression of driving knob portion 19, with positive tactile response. In the above description, press switch 38 is disposed on the top face of flexible insulated substrate 39. However, the switch can be disposed in other positions, such as in the center of spacer 14B between flexible insulated substrate 39 and wiring board 12.

(Fifth Exemplary Embodiment)

Figure 21:
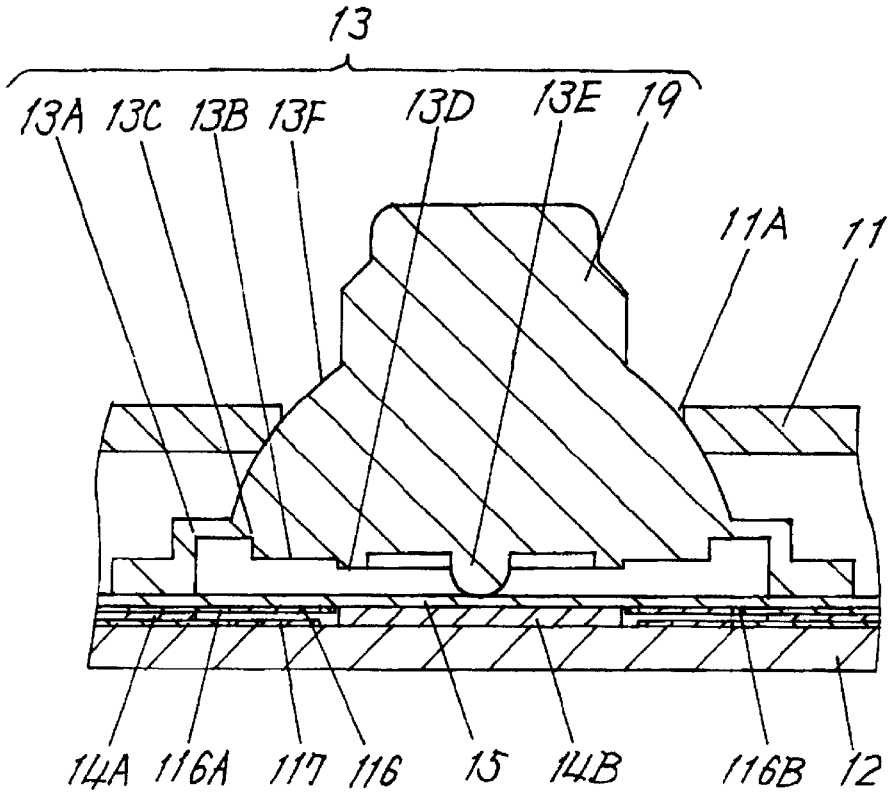
FIG. 21 is a sectional view of an essential part of a multi-directional input device in accordance with a fifth exemplary embodiment of the present invention.
Figure 22:
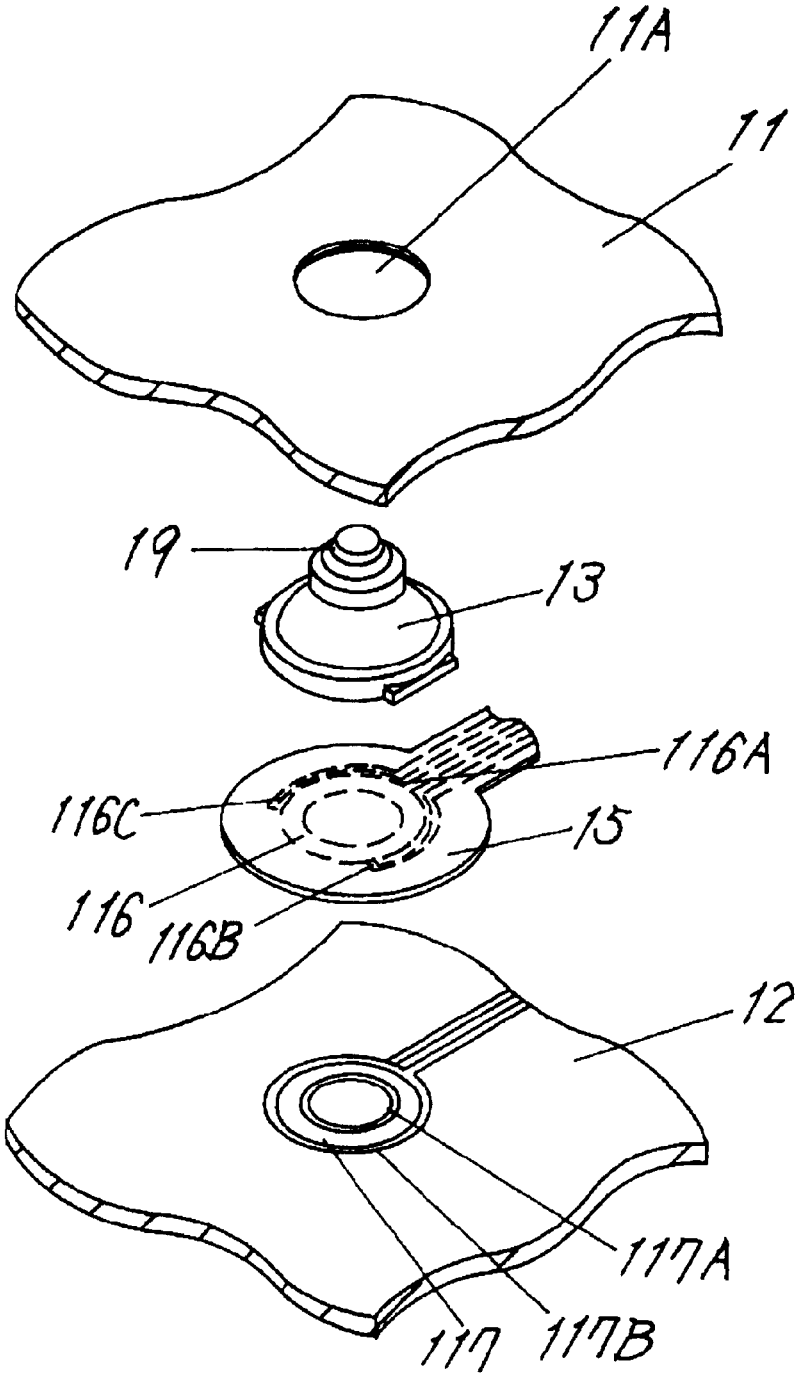
FIG. 22 is an exploded perspective view of the multi-directional input device.
Figure 23:
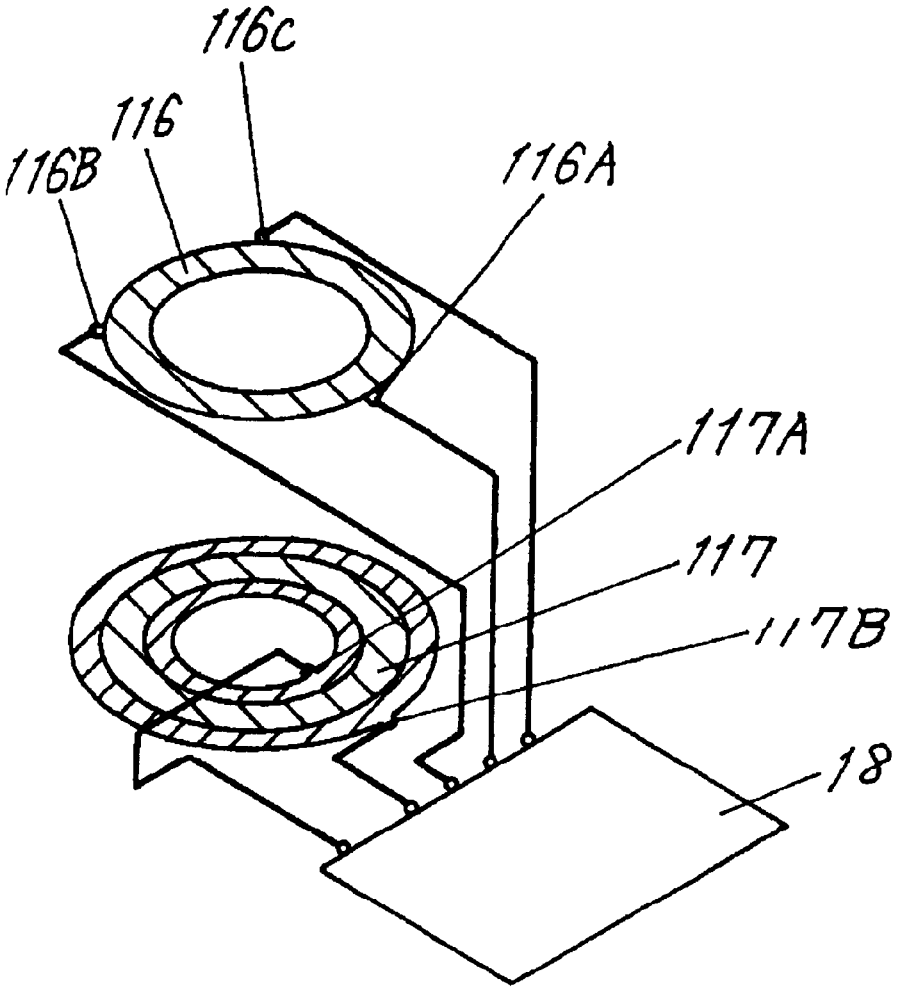
FIG. 23 is a schematic view illustrating a structure of the multi-directional input device.

In this embodiment, a lower conductor layer formed on wiring board 12 and a upper resistor layer formed on flexible insulated substrate 15 have functions inverted from those in the above-mentioned exemplary embodiments. Of course, a multi-directional input device having functions inverted from those of the above-mentioned exemplary embodiments are included in the scope of the present invention. FIG. 21 is a sectional view of an essential part of electronic equipment using a multi-directional input device in accordance with the fifth exemplary embodiment of the present invention. FIG. 22 is an exploded perspective view of the part of the multi-directional input device. FIG. 23 is a schematic view illustrating a structure of the multi-directional input device.

In the drawings, reference numeral 11 shows an upper case of the electronic equipment. Reference numeral 12 shows a planar wiring board. The top surface of upper case 11 is an operation surface. Fitted in circular hole 11A in the center of the upper case is spherical portion 13F of elastic driver 13 of an electronic component for multi-directional input. Driving knob portion 19 of elastic driver 13 projects from circular hole 11A. Flexible insulated substrate 15 is disposed above wiring board 12 so as to provide a predetermined insulation gap and sandwich spacer 14A therebetween. Printed on the bottom face of this flexible insulated substrate 15 is circular-ring-like upper resistor layer 116 having a predetermined width and a uniform specific resistance. Leads 116A, 116B, and 116C are provided at three points spaced at substantially an equal angle. Printed in a position on wiring board 12 opposite to the upper resistor layer, as a lower conductor layer, is circular-ring-like lower resistor layer 117 having a diameter and width substantially identical with those of upper resistor layer 116 and a uniform specific resistance. The lower resistor layer has two leads 117A and 117B in electrical continuity with the entire inner circumference and the entire outer circumference thereof, respectively. When lead 117A in electrical continuity with the inner circumference of this lower resistor layer 117 is drawn to the backside or lower layer of wiring board 12 using a through hole, more simplified structure can be realized. Such a structure allows further downsizing and more accurate output.

As shown in FIG. 23, two leads 117A and 117B of lower resistor layer 117 and three leads 116A, 116B, and 116C of upper resistor layer 116 are connected to computing unit 18, e.g. a microcomputer (herein after referred to as microcomputer 18) incorporated in this electronic equipment, via respective wiring parts.

Mounted on flexible insulated substrate 15 is the above-mentioned elastic driver 13. Disk-like elastic pressing portion 13B supported by surrounding elastic thin cylinder portion 13A and center projection 13E is opposed to the backside of upper resistor layer 116 with a predetermined clearance. This elastic pressing portion 13B is like a disk that has outer peripheral edge forming squared step 13C. The outer diameter of the pressing portion is larger than the diameter measured at the center of the width of upper resistor layer 16, and smaller than the outer diameter thereof. The elastic driver has circular step 13D that is projected downwardly from the surface of the elastic pressing portion in a position slightly inside of the inner diameter of upper resistor layer 116. At the center of the elastic driver, center projection 13E further projected downwardly is provided. Thus, the bottom face of elastic driver 13 forms a concentric disk of three steps. On the other hand, the upper part of elastic driver 13 forms spherical portion 13F covering entire parts of the top face of elastic pressing portion 13B. The spherical portion is engaged in circular hole 11A through upper case 11 serving as a top cover. In the center of the spherical portion, columnar driving knob portion 19 is provided. Spacer 14B of a rigid body is provided inside of upper resistor layer 116 on flexible insulated substrate 15 and of lower resistor layer 117 on wiring board 12. The part of a multi-directional input device in electronic equipment using the multi-directional input device of this embodiment is structured as above.

Described next are actions of the multi-directional input device structured as above when an input operation is performed thereon. The tip of driving knob portion 19 of elastic driver 13 in an ordinary state in FIG. 21 is depressed in an obliquely downward direction as shown by the arrow in FIG. 24 which a sectional view of an essential part of the input device illustrating an operational state. Then, spherical portion 13F of elastic driver 13 rotates along the edge of circular hole 11A through upper case 11 around a fulcrum at center projection 13E. The elastic driver tilts in a desired direction at a desired angle while elastic thin cylinder portion 13A elastically deforms. As a result the bottom face of elastic pressing portion 13B in the tilt direction moves downwardly and squared step 13C along the outer peripheral edge thereof depresses and partially and downwardly warps flexible insulated substrate 15. This action brings a part of upper resistor layer 116 on the bottom face of the insulated substrate into contact with contact point 20 on lower resistor layer 117. In this state, the outer periphery of circular step 13D also makes contact with flexible insulated substrate 15 on spacer 14B. The depressing force applied to driving knob portion 19 to tilt elastic driver 13 is maximized in this position. FIG. 25 is a schematic view for illustrating a recognition method in this state. With reference to this drawing, first, lead 116A of upper resistor layer 116 is grounded (0 V), a DC voltage (e.g. 5 V) is applied to lead 116B, and lead 116C is opened, as a first recognition condition by microcomputer 18. At this condition, a voltage output at lead 117A (or 117B) of lower resistor layer 117 is read, and compared with pre-stored data by microcomputer 18. These operations provide first data: the position at which the upper resistor layer is in partial contact with the lower resistor layer corresponds to point 21A located between leads 116A and 116B and opposite to lead 116C, or to point 21B on the side of lead 116C.

Next, lead 116B is grounded (0 V), a predetermined DC voltage (e.g. 5 V) is applied to lead 116C, and lead 116A is opened, as a second recognition condition. At this condition, a voltage output at lead 117A (or 117B) is read, and compared with pre-stored data. These operations provide second data: the position at which the upper resistor layer is in partial contact with the lower resistor layer corresponds to point 21C located between leads 116B and 116C and opposite to lead 116A, or to point 21A on the side of lead 116A. Then, microcomputer 18 compares the first data and the second data, recognizes point 21A which is common to both data as the tilt direction, and generates a signal showing the direction. Next, in a state shown in FIGS. 24 and 25, voltage is applied across leads 117A and 117B of the inner and outer circumferences of lower resistor layer 117, as a recognition condition different from those described above by microcomputer 18. When lead 117B of the outer circumference is grounded (0 V) and a DC voltage is applied to lead 117A of the inner circumference, a voltage output at one of the leads of upper resistor layer 116 (e.g. lead 116B nearest to contact point 20) is read, and compared with pre-stored data by microcomputer 18. These operations provide data showing a pressure at which elastic pressing portion 13B depresses flexible insulated substrate 15, i.e. an angle at which elastic driver 13 is tilted.

Figure 24:
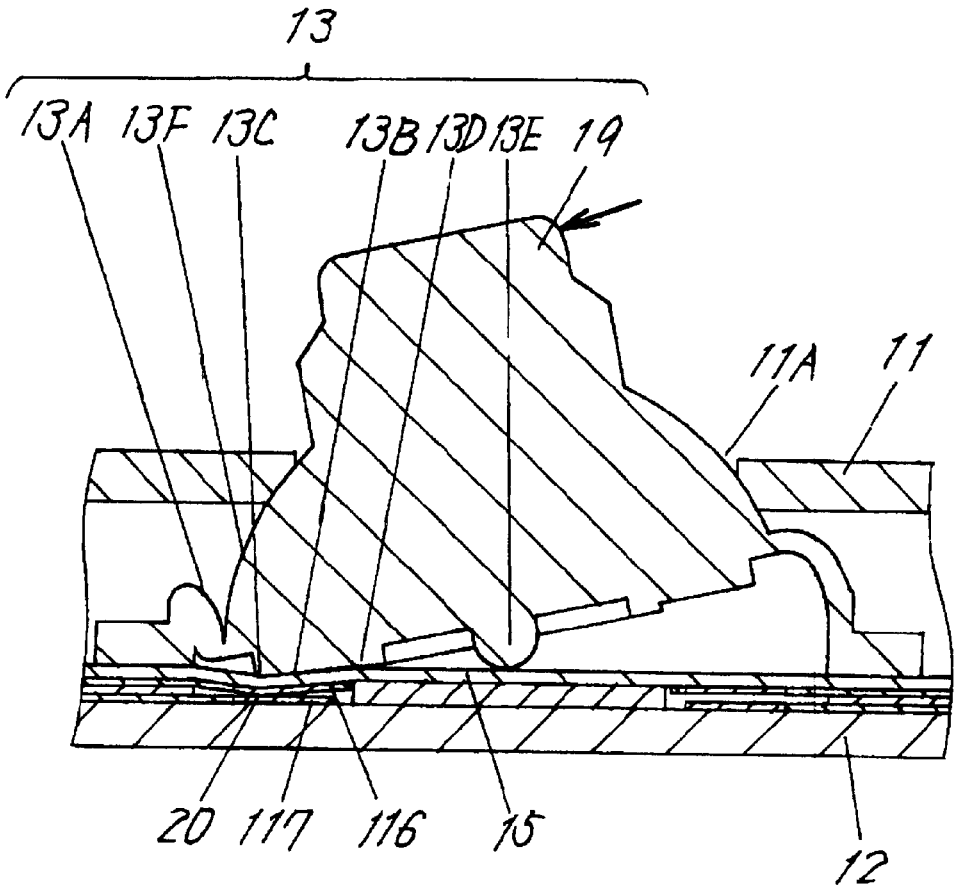
FIG. 24 is a sectional view of an essential part of the multi-directional input device showing an action thereof made when an elastic driver is tilted.
Figure 25:
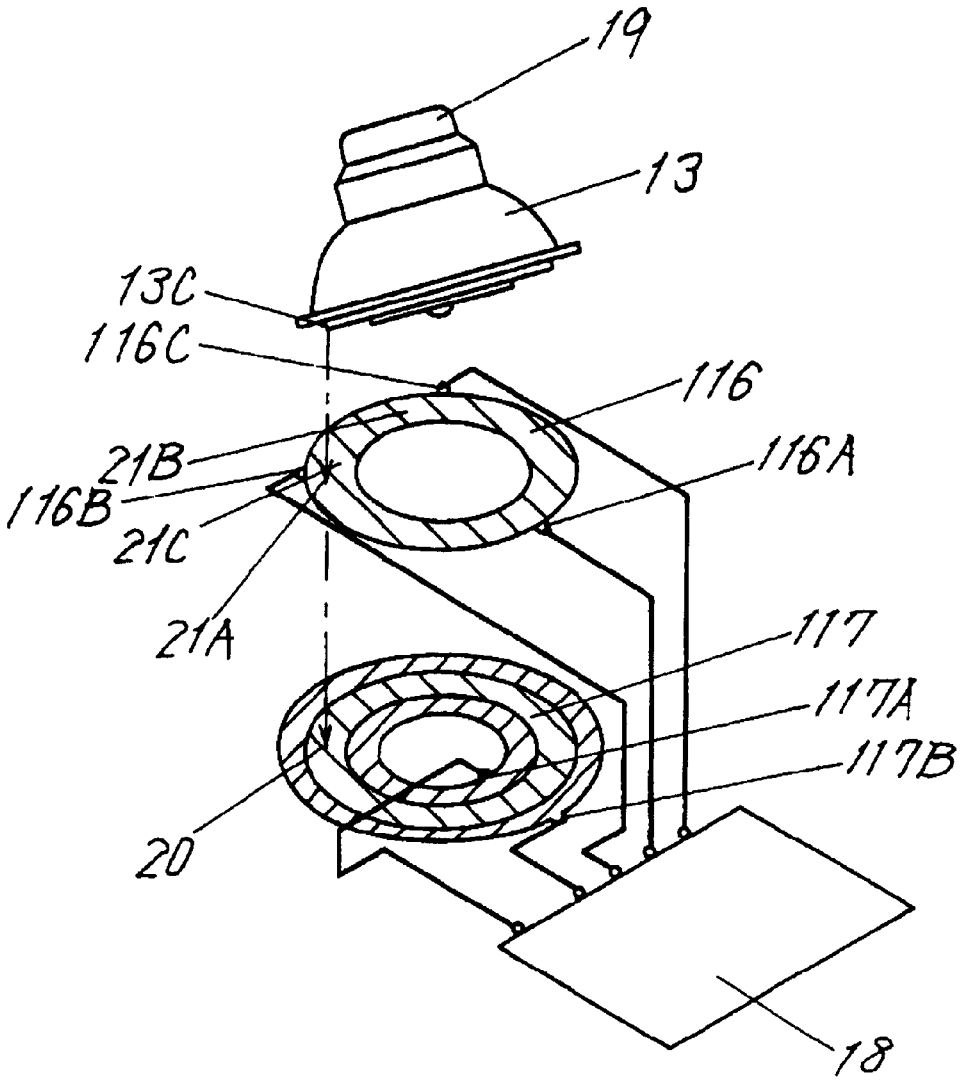
FIG. 25 is a schematic view of the multi-directional input device illustrating a method of recognizing a direction in which the elastic driver is tilted.
Figure 26:
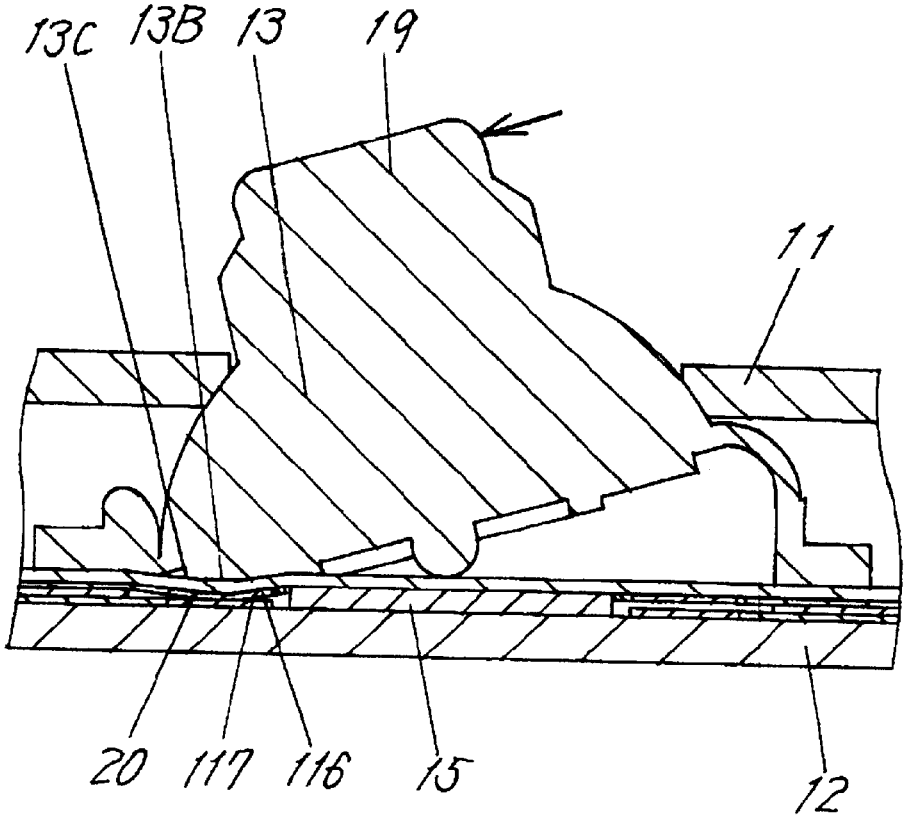
FIG. 26 is a sectional view of an essential part of the multi-directional input device showing an action thereof made when the elastic driver is further tilted.

Depressing the tip of driving knob portion 19 more strongly in the state shown in FIG. 24 more largely tilts elastic driver 13 and elastically deforms the bottom face thereof, thereby increasing the area in which elastic pressing portion 13B depresses flexible insulated substrate 15. This state is shown in FIG. 26 which is a sectional view of an essential part of the input device. As shown in this drawing, the area in which elastic pressing portion 13B of elastic driver 13 depresses flexible insulated substrate 15 increases in the direction from squared step 13C along the outer peripheral edge of elastic pressing portion 13B to the center. Accordingly, the area in which upper resistor layer 116 is in contact with lower resistor layer 117 spreads in the direction from first contact point 20 to the center.

In this state, voltage is applied by microcomputer 18 across leads 117A and 117B of the inner and outer circumferences of lower resistor layer 117 in a manner similar to the above. When lead 117B of the outer circumference is grounded (0 V) and a DC voltage is applied to lead 117A of the inner circumference, a voltage output at one of the leads (116B) of upper resistor layer 116 is read, and compared with pre-stored data by microcomputer 18. These operations provide data showing a pressure at which elastic pressing portion 13B strongly depresses flexible insulated substrate 15, i.e. an angle at which elastic driver 13 is largely tilted. The area of the contact portion including contact point 20 is larger than that in the above-mentioned case. Therefore, the voltage output at one of leads (116B) of upper resistor layer 116 is increased by this increased area. The data value obtained corresponds to an angle at which elastic driver 13 is largely tilted.

In addition, in the above-mentioned method of recognizing a tilt angle of elastic driver 13, lead 117B of the outer circumference of lower resistor layer 17 is grounded (0 V) and a DC voltage is applied to lead 117A of the inner circumference thereof. This is because a larger tilt angle of elastic driver 13 increases the area in which upper resistor layer 116 is in contact with lower resistor layer 117, in the direction from the outer circumference side to the inner circumference side of upper resistor layer 116. Thus, applying DC voltage in the above-mentioned manner can reduce output voltage when the tilt angle is small and contact between both layers is unstable. As a result, unstable areas are eliminated and large output voltages at stable points can be measured and computed to recognize a tilt angle of elastic driver 13. Because these data acquisition and processing are performed when output voltage reaches a predetermined voltage, and repeated at high speed, accurate recognition can be performed.

After the input operations performed in the above-mentioned manner, depressing force applied to the tip of driving knob portion 19 is removed. Then, elastic thin cylinder portion 13A is restored to its original shape by elastic restoring force of its own, and thus elastic driver 13 is returned to its original state shown in FIG. 21. Flexible insulated substrate 15 restores to its original planar state, and thus upper resistor layer 116 and lower resistor layer 117 returns to the opposite state.

As mentioned above, the multi-directional input device of this embodiment recognizes tilt directions and angles of elastic driver 13, using output voltages at respective leads. The output voltages are a plurality of data that are obtained under a plurality of recognition conditions when elastic driver 13 of the electronic component for multi-directional input tilts. Thus, some directions in which input operations can be performed according to tilt angles are added to tilt directions in which a large number of input operations can be performed at high resolution. As a result, input operations can be performed in an extremely large number of directions in total. Therefore, a multi-directional input device having an extremely high resolution of input directions and electronic equipment using the device can be realized.

INDUSTRIAL APPLICABILITY

An electronic component for input in a multi-directional input device of the present invention comprises an upper resistor layer, a lower conductor layer, and an elastic driver for bringing the upper resistor layer into contact with the lower conductor layer. Because of this simple structure, this electronic component for input is easily downsized. The tilt directions and angles of the elastic driver are recognized according to voltage output at each lead when a driving knob portion is depressed in an obliquely downward direction to bring the upper resistor layer and the lower conductor layer into partial contact. This recognition method extremely improves resolution of input directions.

What is claimed is:

1. A multi-directional input device comprising:

an electronic component for input comprising:

an upper resistor layer on a bottom face of a flexible insulated substrate, formed like a circular ring having a predetermined width, and having two leads, one lead in electrical continuity with entire inner circumference and the other lead in electrical continuity with entire outer circumference of the circular ring;

a lower conductor layer on a planar board, disposed like a circular ring so as to be opposed to said upper resistor layer with a predetermined insulation gap, and having a predetermined lead;

a top cover coupled to the planar board and having a circular hole therethrough; and an elastic driver mounted on the flexible insulated substrate, said elastic driver having, on a bottom face thereof, a disk-like elastic pressing portion opposed to a backside of said upper resistor layer with a predetermined clearance, and said elastic driver having, on a top face thereof, a spherical portion rotatably engaged in the circular hole through said top cover and a driving knob portion in a center of the spherical portion;

wherein, while said elastic driver tilts, the elastic pressing portion partially and downwardly warps the flexible insulated substrate, thereby bringing said upper resistor layer and said lower conductor layer in a tilt direction of said elastic driver into partial contact with each other; and a computing unit for recognizing the tilt direction of said elastic driver according to information from the leads of said upper resistor layer and said lower conductor layer while said elastic driver tilts and said upper resistor layer is in partial contact with said lower conductor layer, and for measuring and processing output voltage supplied at the lead of said lower conductor layer when a predetermined DC voltage is applied across the two leads of said upper resistor layer, thereby to recognize the tilt angle of said elastic driver.

2. The multi-directional input device as set forth in claim 1, wherein said lower conductor layer has at least three leads spaced at a predetermined interval; and wherein said computing unit sequentially applies a predetermined DC voltage across at least first predetermined two leads of said lower conductor layer first, and across second predetermined two leads thereof next, while said elastic driver tilts and said upper resistor layer is in partial contact with said lower conductor layer, and said computing unit processes voltage output at one of the leads of said upper resistor layer during said two steps, thereby to recognize the tilt direction of said elastic driver.

3. The multi-directional input device as set forth in claim 1, wherein said lower conductor layer is structured to have a circular-ring-like resistor layer divided into two parts with a predetermined space and to have leads at both ends of each of two resistor layer parts; and wherein said computing unit sequentially applies a predetermined DC voltage across the leads at both ends of each of two lower resistor layer parts while said elastic driver tilts and said upper resistor layer is in partial contact with said lower conductor, and said computing unit reads voltage output at one of the leads of said upper resistor layer at that time, thereby to recognize the tilt direction of said elastic driver.

4. The multi-directional input device as set forth in claim 1, wherein said lower conductor layer is structured to have a circular-ring-like conductor layer divided into parts at a predetermined angle, and to have a lead in each divided part of said conductor layer.

5. The multi-directional input device as set forth in claim 1, further comprising:

a planar conductive plate made of a pressure-sensitive electric conductor wherein thickness-wise depression for input establishes electrical continuity between upper and lower faces in a depressed position;

wherein said conductive plate is inserted in an insulation gap between said circular-ring-like upper resistor layer and lower conductor layer opposed to each other.

6. The multi-directional input device as set forth in claim 1, wherein a specific resistance of said lower conductor layer is smaller than a specific resistance of said upper resistor layer.

7. The multi-directional input device as set forth in claim 1, wherein a conductor layer equivalent to said lower conductor layer is provided on the bottom face of the flexible insulated substrate instead of said upper resistor layer, and a resistor layer equivalent to said upper resistor layer is provided on the planar board instead of said lower conductor layer.

8. The multi-directional input device as set forth in claim 1, wherein said computing unit processes output voltage at the leads of said upper resistor layer and said lower conductor layer to recognize one of the tilt direction and the tilt angle of said driver, when the output voltage reaches a predetermined voltage.

9. The multi-directional input device as set forth in claim 1, wherein said computing unit applies a DC voltage across the two leads of said upper resistor layer by setting the lead on the outer circumference side of said upper resistor layer to a lower voltage, to recognize the tilt angle of said elastic driver.

10. The multi-directional input device as set forth in claim 1, said electronic component for input further comprising:

a manipulation knob made of a rigid material, said manipulation knob including a central hole and a planar bottom surface having an outer diameter substantially identical with an outer diameter of the elastic pressing portion of said elastic driver;

wherein said elastic driver has, on the bottom face thereof, the disk-like elastic pressing portion opposed to the backside of said upper resistor layer with a predetermined clearance, and said elastic driver has, on the top face thereof, a planar surface and a columnar portion in a center of the planar surface; and wherein said manipulation knob is attached to the columnar portion, the planar bottom surface of the manipulation knob is in contact with the planar surface on the top face of said elastic driver in a position within a predetermined diameter, and the planar bottom surface gradually floats from a position of the predetermined diameter to an outer peripheral edge thereof.

11. The multi-directional input device as set forth in claim 1, said electronic component for input further comprising:

a self-restoring press switch actuated by holding down the driving knob portion of said elastic driver, comprising:

a circular dome of a resilient thin metal plate mounted on the flexible insulated substrate under the driving knob portion; and an outer fixed contact and a central fixed contact provided in a center of one of the flexible insulated substrate and the planar board, electrically separated from said circular-ring-like upper resistor layer and lower conductor layer, and short-circuited by resilient inversion of said circular dome.

12. The multi-directional input device as set forth in claim 1, wherein the flexible insulated substrate having said upper resistor layer formed thereon is disposed above said lower conductor layer formed on the planar wiring board in a body of electronic equipment, and the spherical portion of said elastic driver is engaged in a circular hole through an upper case of the electronic equipment.

13. The multi-directional input device as set forth in claim 12, wherein said upper resistor layer is formed on a flexible wiring board disposed over the planar wiring board in the body of the electronic equipment.

14. A multi-directional input device comprising:

an electronic component for input comprising:

an upper resistor layer on a bottom face of a flexible insulated substrate, formed like a circular ring having a predetermined width, and having two leads, one lead in electrical continuity with entire inner circumference and the other lead in electrical continuity with entire outer circumference of the circular ring;

a lower conductor layer on a planar board, disposed like a circular ring so as to be opposed to said upper resistor layer with a predetermined insulation gap, and having a predetermined lead;

a top cover coupled to the planar board and having a circular hole therethrough; and an elastic driver mounted on the flexible insulated substrate, said elastic driver having, on a bottom face thereof, a disk-like elastic pressing portion opposed to a backside of said upper resistor layer with a predetermined clearance, and said elastic driver having, on a top face thereof, a spherical portion rotatably engaged in a circular hole through said top cover and a driving knob portion in a center of the spherical portion;

wherein, when said elastic driver tilts, said elastic pressing portion partially and downwardly warps the flexible insulated substrate, brings said upper resistor layer and said lower conductor layer in a tilt direction into partial contact with each other, and in this state, a tilt direction and a tilt angle of said elastic driver are recognized according to information from the leads of said upper resistor layer and said lower conductor layer.

15. The multi-directional input device as set forth in claim 14, wherein said lower conductor layer has at least three leads spaced at a predetermined interval.

16. The multi-directional input device as set forth in claim 14, wherein said lower conductor layer is structured to have a circular-ring-like resistor layer divided into two parts with a predetermined space and to have leads at both ends of each of two resistor layer parts.

17. The multi-directional input device as set forth in claim 14, wherein said lower conductor layer is structured to have a circular-ring-like conductor layer divided into parts at a predetermined angle, and to have a lead in each divided part of said conductor layer.

18. The multi-directional input device as set forth in claim 14, said electronic component for input further comprising:

a planar conductive plate made of a pressure-sensitive electric conductor wherein thickness-wise depression establishes electrical continuity between upper and lower faces in a depressed position;

wherein said conductive plate is inserted in an insulation gap between said circular-ring-like upper resistor layer and lower conductor layer opposed to each other.

19. The multi-directional input device as set forth in claim 14, wherein a specific resistance of said lower conductor layer is smaller than a specific resistance of said upper resistor layer.

20. The multi-directional input device as set forth in claim 14, wherein a conductor layer equivalent to said lower conductor layer is provided on the bottom face of the flexible insulated substrate instead of said upper resistor layer, and a resistor layer equivalent to said upper resistor layer is provided on the planar board instead of said lower conductor layer.

21. The multi-directional input device as set forth in claim 14, said electronic component for input further comprising:

a manipulation knob made of a rigid material, said manipulation knob including a central hole and a planar bottom surface having an outer diameter substantially identical with an outer diameter of the elastic pressing portion of said elastic driver;

wherein said elastic driver has, on the bottom face thereof, the disk-like elastic pressing portion opposed to the backside of said upper resistor layer with a predetermined clearance, and said elastic driver has, on the top face thereof, a planar surface and a columnar portion in a center of the planar surface;

wherein said manipulation knob is attached to the columnar portion, the planar bottom surface of said manipulation knob is in contact with the planar surface on the top face of said elastic driver in a position within a predetermined diameter, and the planar bottom surface gradually floats from a position of the predetermined diameter to an outer peripheral edge thereof.

22. The multi-directional input device as set forth in claim 14, said electronic component for input further comprising:

a self-restoring press switch actuated by holding down the driving knob portion of said elastic driver, comprising:

a circular dome of a resilient thin metal plate mounted on the flexible insulated substrate under the driving knob portion; and an outer fixed contact and a central fixed contact provided in a center of one of the flexible insulated substrate and planar board, electrically separated from said circular-ring-like upper resistor layer and lower conductor layer, and short-circuited by resilient inversion of said circular dome.

23. The multi-directional input device as set forth in claim 14, wherein the flexible insulated substrate having said upper resistor layer formed thereon is disposed above said lower conductor layer formed on the planar wiring board in a body of electronic equipment, and the spherical portion of said elastic driver is engaged in a circular hole through an upper case of the electronic equipment.

24. The multi-directional input device as set forth in claim 23, wherein said upper resistor layer is formed on a flexible wiring board disposed over the planar wiring board in the body of the electronic equipment.

* * * * *